US010961047B2

(12) United States Patent
Lawlis

(10) Patent No.: US 10,961,047 B2
(45) Date of Patent: Mar. 30, 2021

(54) INTERNAL FLOATING ROOF TRANSFER TANK SYSTEM

(71) Applicant: David Lawlis, Tulsa, OK (US)

(72) Inventor: David Lawlis, Tulsa, OK (US)

( * ) Notice: Subject to any disclaimer, the term of this patent is extended or adjusted under 35 U.S.C. 154(b) by 789 days.

(21) Appl. No.: 15/279,427

(22) Filed: Sep. 28, 2016

(65) Prior Publication Data

US 2018/0086550 A1 Mar. 29, 2018

(51) Int. Cl.
*B65D 88/42* (2006.01)
*B65D 90/10* (2006.01)

(52) U.S. Cl.
CPC ..... *B65D 88/42* (2013.01); *B65D 90/10* (2013.01)

(58) Field of Classification Search
CPC ..... B65D 88/42; B65D 90/10
USPC ..... 220/222, 220, 221, 216
See application file for complete search history.

(56) References Cited

U.S. PATENT DOCUMENTS 1,665,163 A * 4/1928 Gallagher ..... B65D 88/34 220/219
1,752,197 A * 3/1930 Patterson ..... B65D 90/34 137/587
2,244,782 A * 6/1941 Jones ..... B65D 88/34 137/552
2,366,911 A 1/1945 Laird
3,535,236 A * 10/1970 Travis ..... B65D 88/34 210/136
4,240,562 A * 12/1980 Holschlag ..... B65D 90/08 220/565
4,243,151 A * 1/1981 Bruening ..... B65D 88/34 220/216
4,286,726 A * 9/1981 Madsen ..... B65D 88/40 220/220
4,541,210 A * 9/1985 Cook ..... E04B 7/102 52/745.01
4,648,948 A * 3/1987 Meshbesher ..... C25B 3/02 204/DIG. 4
5,147,418 A 9/1992 Laverman
5,230,436 A * 7/1993 Vaughn ..... B65D 88/46 220/220
5,284,269 A * 2/1994 Petrie ..... B65D 88/46 220/221
5,605,243 A * 2/1997 Jolly ..... B65D 88/34 220/216
5,704,509 A 1/1998 Rosenkrantz
6,039,123 A 3/2000 Webb
6,164,479 A 12/2000 Kern
6,929,142 B2 8/2005 Gilbert
8,061,522 B2 11/2011 Hiner
8,281,543 B2 * 10/2012 Cook ..... C12M 21/04 220/216
2007/0164034 A1 * 7/2007 Lee ..... B65D 90/022 220/565

(Continued)

OTHER PUBLICATIONS

Seven Surveyor, Faisal Yusuf, Petroleum Calculation Series: Definition, Nov. 10, 2011, pp. 1-7, http://www.sevensurveyor.com/petroleum-calcuation-series-definition/.

*Primary Examiner* — J. Gregory Pickett
*Assistant Examiner* — Niki M Eloshway
(74) *Attorney, Agent, or Firm* — Juneau; Todd Juneau

(57) ABSTRACT

The invention relates to an improved transfer tank having a improved internal floating roof with special vapor sealing features, and wherein the tank ranges in storage size from 750 to 5000 barrels.

12 Claims, 33 Drawing Sheets

(56) References Cited

U.S. PATENT DOCUMENTS

| | | | | |
|---|---|---|---|---|
| 2009/0321447 | A1* | 12/2009 | Imhof | B65D 88/34 220/222 |
| 2014/0231431 | A1 | 8/2014 | Rosencrantz | |
| 2015/0284180 | A1* | 10/2015 | Glowacki | B65D 88/022 220/1.5 |

* cited by examiner

ORIENTATION

108 INTERNAL FLOATING ROOF LAYOUT

RIM ANGLE DETAIL

SHELL TO BOTTOM WELD DETAIL (1) REQUIRED AS SHOWN

291 GASKET DETAIL

INTERNAL FLOATING ROOF TRANSFER TANK SYSTEM

CROSS REFERENCE TO RELATED APPLICATIONS

None

STATEMENT REGARDING FEDERALLY SPONSORED RESEARCH OR DEVELOPMENT

None

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to above ground volatile liquid transfer tanks, and in particular, a Improved Internal Floating Roof Transfer Tank System.

Background

Transfer tanks are used to hold liquids being transferred by truck or pipeline before being transported to a storage location, or a processing location.

Bulk fluids such as petroleum and other liquid fuel and chemical products are often stored in large cylindrical tanks. A large number of industrial processes require the use of substantial quantities of volatile liquids such as gasoline, alcohol, etc. The industries utilizing these processes store a wide range of volatile liquids in large storage vessels. The storage vessels are typically constructed of steel, stainless steel, aluminum and reinforced concrete, among other construction materials, depending upon the size and location of the storage vessel, the material stored inside the tank, and the industrial process generating or using the contained liquid.

Many of these storage vessels have a fixed roof either integral with the vessel or retrofitted over the vessel for the dual purposes of keeping contaminants, e.g., water, dust and other particulate contaminants, out of the stored liquid and for reducing evaporative losses of the stored liquid for both economic and regulatory reasons. Storage vessels with a roof are commonly referred to as "covered" storage tanks.

If the liquid stored in the large-scale vessels is readily subject to evaporation at ambient pressure and temperature based upon their physical and chemical properties, additional control devices are commonly used to minimize losses from evaporation. Escaping vapors of many hydrocarbon based liquids can present health, safety or fire hazards. Vapors from flammable liquids can form an explosive mixture with air when an appropriate blend of stored liquid vapor and oxygen exists. Other liquids, particularly those containing sulfur, can present an objectionable odor when permitted to evaporate freely.

Over the years a variety of additional evaporative control devices have been utilized to control the escaping vapors from the liquids contained in the large-scale storage tanks. One common and effective variety of such control devices are liquid and vapor impervious buoyant structures that float on the liquid surface and are commonly referred to as "floating roofs." If the storage vessel is covered with a separate structural roof, the floating roof is denominated as an "internal" floating roof. If the storage vessel does not have a roof or cover, the floating roof is denominated as an "external" floating roof. An external floating roof serves the dual purposes of keeping weather and airborne contaminants away from the stored liquid and in reducing evaporative losses.

Although many different types of floating roofs have been manufactured, most fit into two categories: vapor space and full contact floating roofs. Vapor space floating roofs typically contain a plurality of closed and sealed buoyant members for supporting an impervious membrane above the liquid surface. The buoyant members create a vapor space between the liquid surface and the underside of the impervious membrane. If any mechanical joints, seams or holes exist or are created through continued use in the membrane, liquid vapors from the vapor space below the membrane can leak through the membrane to the ambient atmosphere above the membrane creating a potentially hazardous atmosphere as well as an evaporative condition for the stored liquid. Full contact floating roofs are configured with the membrane in substantial contact with the surface of the stored liquid eliminating any vapor space below the membrane. Such full-contact membranes are typically the lower portion of closed and sealed buoyant members. While this is an improvement in creating a floating barrier for retaining the liquid in a non-evaporative state, thus controlling evaporation, there still exists the problem of mechanical joints, seams and holes that provide points of leakage. Additionally, creating and testing the closed and sealed buoyant compartments requires specialty materials, highly skilled designers and fabricators while testing and maintaining these compartments involves additional skills and work.

Existing designs for full contact floating roofs fall into two broad categories, i.e., monolithic and segmented. The present invention falls into the category of a segmented floating roof. Segmented floating roofs are typically fabricated off site and assembled within the storage tank. Each of the plural segments is typically comprised of a composite panel with edge closures that facilitate assembly one to the other. The composite panel is a structural component comprising an upper and a lower strong relatively thin metallic skin separated by and bonded to a lightweight edge material that creates a box-like form for the panel. Within the composite panel may be a core comprised of, for example, polyurethane foam or honeycomb aluminum to fill the void between the top and bottom skins and to assist in the buoyancy of the floating roof. The edge materials are connected together along their top and/or bottom edges with, for example, bolts and nuts or, for another example with a retaining hook along the bottom of a first panel for holding a distending flange of a second panel within the hook of the first panel as described in U.S. Pat. No. 5,704,509.

This description of a composite panel floating roof is provided to afford the reader with a reasonable understanding of the types of construction used in presently available floating roofs. However, there remain structural flaws that need to be addressed to further reduce evaporation, collection of volatile gases below and in the enclosed panel spaces, and reduce the vertical height to achieve less overall weight increasing the buoyancy and permitting greater storage capacity in the tank.

One of the noticed problems with the present designs for floating roof panels is the penetration through the hook and distending flange attachment between panels. This type of attachment arrangement permits the slow leakage (evaporation) of the contained liquid upward through any joint that is not rigidly held in absolute parallel to its adjoining edge member. Further, the hook may allow for some slippage away from the rigid joint through continued use. It is, therefore, an object of the present invention to eliminate the potential for slippage of adjoining panel edges away from one another by substituting a securing member for holding the edge joint in rigid contact along its entire length.

Another of the problems with the present designs for floating roof panels is the presence of fasteners in a potential vapor escape path that allow the passage of vapors to the space above the floating roof. The present invention eliminates the need for such fasteners or connections.

Another of the problems is the leakage of the liquid and/or vapors into the interior space of the composite panel creating a potentially hazardous condition and defeating the buoyancy characteristics for that panel. The present invention eliminates the top skin which, in turn, eliminates a potential collection space for harmful vapors in the core space of the panel. The present invention also eliminates the core material as the space between the edge members is now open to the ambient atmosphere. Thus, it is an object of the present invention to eliminate a collection space for harmful vapors by eliminating the upper skin and the core space. This, in turn, eliminates the need for buoyant core materials and allows for direct inspection of the bottom skin for leakage.

One other problem has been the additional buoyant members placed beneath the floating roof to maintain its buoyancy where required (typically at the outer edge of the floating roof where additional equipment is installed on top of the floating roof) and the subsequent loss of contact with the liquid surface. The buoyant members continually were in need of replacement as the liquids contained in the tanks seeped into them and destroyed their buoyancy. The present invention is a full contact floating roof that does not require additional buoyant members for floating support. It is another object of the present invention to eliminate the need to test and inspect the main and additional buoyant members for content and/or replacement. It is another object off the present invention to reduce the vertical profile of the internal floating roof and gain the efficiencies of lesser height increasing the potential volumetric capacity of the tank or container.

An additional problem is vapor leakage through the elongated mechanical seams between the edge members of the panels. Evaporative leakage is a problem as vapors can build up in the ambient atmosphere within the tank above the floating roof If the seams are not absolutely tight, vapor can leak between the adjoining surfaces of the edge members even if they look as if there is no visible space therebetween. The present invention eliminates this source of leakage by placing a sealing means along the entire elongated surface of adjoining panel edge members. In this way leakage due to poor sealing between edges or due to panel warpage is eliminated.

A further problem is that when crude oil or frac oil (liquids obtained from a fracked oil well) is being transported from the wellhead, there is initially a great need for temporary nearby storage. As the well production tapers off over the first year or so, the need for local temporary tanks is reduced, create a tank resource allocation problem. Also, frac oil is isgnificantly different from standard crude oil. Frac oil contains a larger amount of entrained volatiles, entrained water, and hydrogen sulfide gas. Putting such a mixture into a standard storage tank will allow these various components to separate, which is not good outside of the refinery setting, and causes significant problems with pipelines, tracks, and rail tanks, including explosion hazards, spill hazards, and equipment degradation hazards.

SUMMARY

The present invention provides an Improved Internal Floating Roof Transfer Tank System to address the failings of prior storage tanks. The invention uses smaller tank sizes ranging from 750 to 1000 to 5000, 10,000 to 30,000 barrels (31,500-210,000-1,260,000 U.S. Gallons) compared to much larger tanks used in the industry. Larger tanks, e.g. 300+ feet in diameter and shell height exceeding 50 feet, are designed to hold over 1 million barrels of liquids (capacity of a cylinder $\pi r^2 h$). By using a smaller size, many advantages are gained, including that the tank is easier and faster to fill, and to drain, easier to inspect, faster to clean, and is more structurally sound from a material-to-dimension ratio viewpoint. A smaller tank also provide the ability to transport by truck, raise by crane, and move the tanks as desired. Larger storage tanks are immovable structures. Another advantage is that smaller tanks do not have the settlement issue that large tanks suffer from, and there is less wear on a smaller tank since the stored liquids generate less force on the structure since there is less being stored, meaning that the tanks will last longer. Another advantage is that, by reducing the size of the tank, it also reduces the amount of vapor that can build up, reducing the hazards of toxic fumes on personnel, as well as the hazards from explosions and accidental spills. It also means that fire suppression mechanisms can be more effective. And by installing an array of smaller tanks instead of a single large tank, the invention allows the creation of an expandable tank cluster when a wellhead is achieving high output capacity, and the removal and re-allocation of tanks to a new location when the wellhead tapers off. A cluster of tanks also provides storage of multiple liquids within the same spill yard, modular replacement of individual units for maintenance, and compartmentalization of loss should a single tank fail it will not affect the entire storage cluster.

Another feature of the invention is the use of vertically oriented storage tanks. Tradition storage tanks are disk-shaped, wider than they are tall. The invention provides tanks having approximately a height to diameter ratio of 2:1. For example, a 32 foot tall storage tank has a 15.5 foot diameter. This vertical orientation changes the vapor profile within the tank, affecting the structure, the use, the safety, and the operation of the internal floating roof. The vertical feature changes the forces on the seal for the internal floating roof, with less damage to seal. By having a taller tank with a 2:1 height/diameter ratio, the design facilitates unloading of trucking tankers and transferring crude oil into pipelines with no emissions escaping the tank in the process.

Another feature of the invention is the improved internal floating roof. The IFR has a solid, unitary bottom plate piece, with no fabric panels as prior devices have. The improved IFR has a high sidewall, which increases sealing with the attached wiper gasket, and smooths vertical traveling within the storage tank. The high sidewall also allows space for a second wiper if wanted by customer. The desk of the IFR rigid, not flexible, and extends within the tank across the diameter of the tank wall to wall. The improved IFR has bulkheads configured as vertical support spokes attached to a central support hub. Unlike prior tanks, the IFR does not fold, is not segmented or sectional, but has a rigid deck. The IFR deck includes a viewing port, an overflow port, and is configured to travel vertically along a centrally located vertically mounted pipe that extends through the desk, run from the bottom of the tank to the roof through a gasketed port in the IFR deck, where the pipe functions doubly as one of the two vertical rails of a vertical ladder within the tank. The improved IFR does not include floats or pontoons and floats directly on surface of liquid, where it is passively raised and lowered by the level of liquid in tank. Additionally, it may include cables for raising and lowering. One important feature of the IFR is a set of internal legs extending a short distance from the bottom of the tank where a lowered IFR in an emptied tank can be attached to the legs to secure the IFR for stability during transportation of the storage tank. These legs can be unbolted at target location for the tank, but can be bolted again if moved to another location without damaging the IRF.

Another feature of the invention is a serial connection port for connecting a tank in series to other tanks. This pipe connector allows clustering of transfer tanks, and transfer tank clusters give storage capability of large tank while mitigating risks from large tanks. The pipe connection can also be used to reduce vapor build up problems if venting in one tank fails.

The improved storage tank is also API-650 compliant, like larger tanks, and includes multiple vents, including a shorter, larger "hatbox" vent which is an automatic explosion proof vent for atmospheric tanks, 4# to 6# by others, and downward facing sidewall vents which allow the IFR to move up and down without creating a vacuum, and to allow vapors to discharge freely. API-650 also requires a round access panel in the sidewall of the tank, and a square access door which is API 12F compliant, since tanks are cleaned with vacuum trucks, there is no mopping of the bottoms and getting an oil spill on the ground.

The improved transfer tanks are constructed of welded steel panels, not bolted steel panels, and can be a single walled or double walled construction. The tanks can be optionally fitted with internal lining to support storage of liquids that require special handling. And the tanks can be used to transfer, or optionally store, crude oil, drilling fluids, distillates, Condensate C5+, wastewater, petrochemicals, water, agriculture chemicals, hazardous materials, as well as winery and brewery liquids.

In one preferred embodiment, there is provided a full contact internal floating roof for a transfer tank, comprising: a rigid horizontal circular deck; a rigid vertical sidewall attached around the circumferential periphery of the circular deck, the sidewall extending perpendicularly from the circular deck; a rigid circular manway hub attached to a center region of the circular deck, the rigid circular manway hub having a removable cover; a plurality of bulkhead spoke members mounted on the deck and extending vertically in the same direction perpendicularly as the sidewall, the bulkhead spoke members extending horizontally and connecting the manway hub to the vertical sidewall at regular intervals; at least one mechanical wiper disposed on the outer surface of the vertical sidewall for providing an operational seal with an inner shell wall of a transfer tank; a pressure vent mounted on the deck, the pressure vent comprising a sleeve that extends through the deck, and a gasketed pipe disposed within the sleeve, a bleeder valve caps the pipe; a rigid gasketed sleeve mounted on the deck, the gasketed sleeve extends through the deck providing a sealed aperture through the deck; an anti-rotation device extending vertically from a floor of the transfer tank through the gasketed sleeve of the circular deck and continuing vertically through a roof of the transfer tank, the anti-rotation device configured to have a cross-sectional shape operatively matching a cross-sectional shape of the gasketed sleeve, wherein the circular deck is prevented from rotating about a vertical axis.

In another preferred embodiment, there is provided an internal floating roof wherein the deck comprises a removable deck leg, the deck leg removably connecting the internal floating roof to the tank to prevent movement of the internal floating roof during transportation of the tank.

In another preferred embodiment, there is provided an internal floating roof wherein the circular deck is made of steel.

In another preferred embodiment, there is provided an internal floating roof wherein the plurality of bulkhead spoke members is 6 bulkhead spoke members.

In another preferred embodiment, there is provided an internal floating roof wherein the at least one mechanical wiper is two mechanical wipers.

In another preferred embodiment, there is provided an internal floating roof wherein the anti-rotation device is configured in the shape of a ladder.

In another preferred embodiment, there is provided a liquid transfer tank that has a shell wall and a full-contact floating roof of claim 1 designed to move vertically within the tank, floating upon the surface of product stored in the tank, the tank having: a cone-shaped roof, the cone-shaped roof having a roof port/sleeve, the roof port/sleeve having the anti-rotation device disposed there through; a cylindrical shell wall connecting the cone-shaped roof to a tank bottom panel, the shell wall having a circular first manway disposed therethough, and having a rectilinear second manway disposed therethrough.

In another preferred embodiment, there is provided a liquid transfer tank wherein the tank ranges in storage capacity from 750 to 5000 barrels.

In another preferred embodiment, there is provided a liquid transfer tank wherein the tank dimensions have a height to diameter ratio ranging from 1.5 to 3.0.

In another preferred embodiment, there is provided a liquid transfer tank wherein the tank dimensions have a height to diameter ratio ranging from 1.75 to 2.5.

In another preferred embodiment, there is provided a liquid transfer tank wherein the tank dimensions are 32 feet in height and 15.5 feet in diameter.

In another preferred embodiment, there is provided wherein the circular deck is from 10 to 20 feet in diameter, is from 14 to 18 feet in diameter, and/or is 15.5 feet in diameter.

In another preferred embodiment, there is provided wherein the rigid vertical sidewall is from 6 to 36 inches in height above the IFR deck, is from 12 to 30 inches in height above the IFR deck, and/or is 24 inches in height above the IFR deck.

In another preferred embodiment, there is provided wherein the manway hub is from 24 to 36 inches in diameter. and/or wherein the manway hub has a hinged cover.

In another preferred embodiment, there is provided wherein the bulkhead spoke members are 4 to 9 feet in length from an outer surface of the manway hub to the vertical sidewall, and/or wherein the bulkhead spoke members are 6.25 feet in length.

In another preferred embodiment, there is provided wherein the bulkhead spoke members are 6 to 30 inches in height above the IFR deck, are the same height above the IFR deck as the vertical sidewall, and/or are less than the height of the manway hub.

In another preferred embodiment, there is provided wherein the at least one mechanical wiper is disposed on an upper portion of the outer surface of the vertical sidewall, said upper portion distal from the IFR deck, or wherein the at least one mechanical wiper is disposed on a lower portion of the outer surface of the vertical sidewall, said lower portion proximal to the IFR deck, or wherein the at least one mechanical wiper is disposed on a central portion of the outer surface of the vertical sidewall.

In another preferred embodiment, there is provided wherein the at least one mechanical wiper comprises two mechanical wipers, wherein a first of the two mechanical wipers disposed on an upper portion of the outer surface of the vertical sidewall, said upper portion distal from the IFR deck, and a second of the two mechanical wipers disposed on a lower portion of the outer surface of the vertical sidewall, said lower portion proximal to the IFR deck, or wherein the at least one mechanical wiper comprises two mechanical wipers, wherein both of the two mechanical wipers are disposed on an upper portion of the outer surface of the vertical sidewall, said upper portion distal from the IFR deck, or wherein the at least one mechanical wiper comprises two mechanical wipers, wherein both of the two mechanical wipers are disposed on a lower portion of the outer surface of the vertical sidewall, said lower portion proximal to the IFR deck.

In another preferred embodiment, there is provided wherein the pressure vent is greater than the manway hub in height above the IFR deck, and/or wherein the pressure vent is greater than the vertical sidewall in height above the IFR deck.

In another preferred embodiment, there is provided wherein the rigid gasketed sleeve has a cross-sectional rectangular shape with a diameter from 24 to 36 inches in one dimension, wherein the rigid gasketed sleeve is greater than the vertical sidewall in height above the IFR deck, and/or wherein the rigid gasketed sleeve is less than the manway hub in height above the IFR deck.

In another preferred embodiment, there is provided wherein the anti-rotation device is configured to have a rectangular cross-sectional shape, is configured to have a cylindrical cross-sectional shape, is configured to have an irregular curvilinear cross-sectional shape, and/or is configured to have an irregular rectilinear cross-sectional shape.

In another preferred embodiment, there is provided a tank that has a height governor attached to an upper portion of the shell adjacent the roof to prevent the IFR from rising too far and making contact with the roof, and wherein the height governor may comprise one or more cables or shelf units deployed across the top portion of the highest shell stack adjacent the roof In another preferred embodiment, there is provided a tank having an inlet port having a diffuser, and wherien the diffuser may be a pipe having radiator holes or a pipe fitting that causes the liquid to spray during loading.

DETAILED DESCRIPTION OF THE INVENTION

Figure 1:
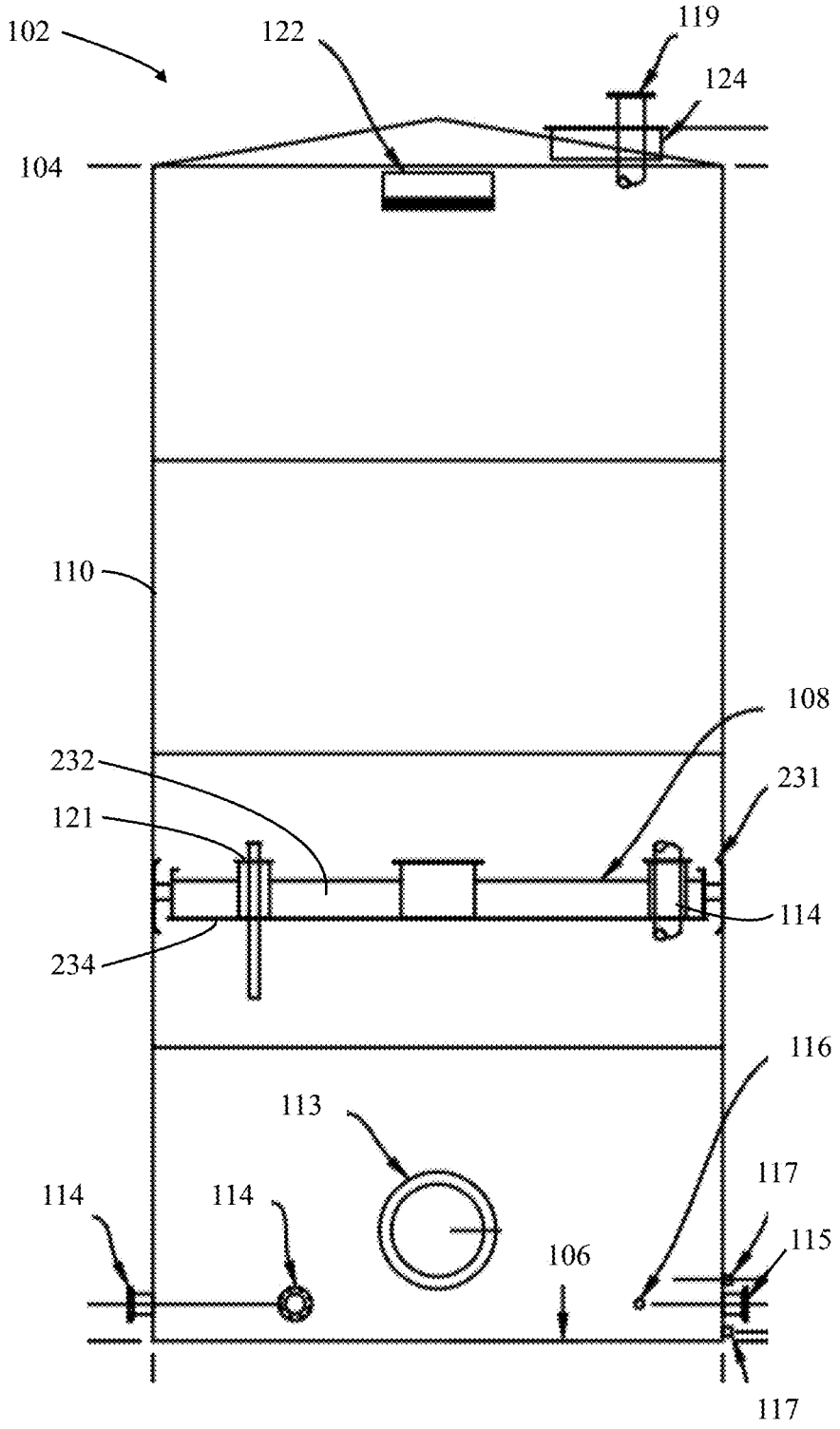
FIG. 1 is an elevation view of one preferred embodiment of an improved transfer tank.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Rather, these embodiments are provided so that this disclosure will be thorough and complete, and will fully convey the scope of the invention to those skilled in the art. Like numbers refer to like elements throughout. As used herein the term "and/or" includes any and all combinations of one or more of the associated listed items.

The terminology used herein is for the purpose of describing particular embodiments only and is not intended to limit the full scope of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following terms, as used herein, have the following meanings:

"Internal floating roof" (IFR) refers to a disk-shaped structure within a storage tank or transfer tank having roughly the same diameter as the tank, and having the ability to float on top of the stored liquid and rise or lower vertically with the differing volumes of liquid being stored. This helps achieve a no-vapor zone. The objective of the IFR is to minimize or completely eliminate the potentially gaseous zone above stored liquid, both as a safety feature and to reduce corrosion of vaporous oxidizing elements on the inside of the tank.

"Anti-rotation device" (ARD) refers to a pipe ladder that runs vertically from the interior floor of the tank through the internal floating roof, and exiting through a port/sleeve in the roof of the tank. This structure prevents the IFR from rotating and thus avoids generating the friction and possible sparking of prior designs.

"Manway" refers to a sealed port for accessing a transfer tank or storage tank.

"Mechanical shoe seal/wiper" refers to an annular device on the outer rim of the IFR that provides a seal between the IFR and the inner surface of the shell of the tank. The taller profile sidewalls of the inventive rigid IFR provides superior sealing abilities.

"Deck legs" refers to hold-down devices for securing the internal floating roof during transport. Since the inventive tanks are portable, unlike traditional tanks, the deck legs prevent damage to the IFR or the tank shell.

"Cluster" refers to a close array of inventive tanks as disclosed herein with a single location, Tank are generally installed within a distance ranging from 1-3 tank-diameters. But they may be spaced from 1-10 tank diameters as contemplated herein, unless claimed as smaller.

"Array" refers to a systematic arrangement of data in rows and columns. An example of an array is a matrix which is a rectangular array of numbers, symbols, or expressions.

"A floating roof storage tank" refers generally to a solid cylindrical outer wall covered by a solid dome-shaped roof. A floating roof is held within the volume defined by the outer wall and roof. The floating roof extends over the liquid contents held within the volume, and forms a vapor seal around the internal circumference of the cylindrical wall. The height within the tank at which the floating roof is positioned varies according to the amount of liquid being stored within the tank and the rate at which the liquid is pumped out of the tank.

Full-contact floating roofs have the vapor retention membrane on the liquid surface. Full-contact floating roofs do not have a vapor space underneath the membrane and are an improved method of controlling evaporation losses and minimizing explosive mixtures. These are an improvement over Vapor-space floating roofs that typically have a plurality of buoyant members supporting an impervious membrane above the liquid surface. Any mechanical joints, seams or holes in the membrane can leak vapors from the vapor space below the membrane to the ambient atmosphere above the membrane. Leaks in the membrane allow vapors to escape from the entire reservoir of vapors under the floating roof Full contact floating roof includes two broad categories: monolithic and segmented. Monolithic full contact floating roofs are constructed inside the vessel in one large unit with no mechanical joints, seams or breaks in the part of the roof in contact with the product. One example of this design is an all welded steel floating roof resembling a frying pan. The edge of this style "pan" roof is high enough so that liquid cannot flood over the top edge and sink the roof. Segmented full contact floating roofs are shop fabricated into modules that are field assembled inside the vessel. Each segment typically comprises a composite panel with edge closures that facilitate assembly. A composite panel is a structural component comprising two strong relatively thin skins (usually metallic) separated by and bonded to a lightweight material of a thickness usually many times greater than the thickness of the skins. For segmented full contact floating roofs, the skins are commonly aluminum of 0.015 to 0.050 inches thick and the core is commonly 1½" to 3" thick polyurethane foam or 1½" to 3" thick aluminum honeycomb made from 0.003" to 0.005" thick aluminum foil in ¾" to 1" hexagonal cells.

During normal operation of storage vessels containing liquids, static electric charges are generated. These charges can be anywhere in or on the liquid surface. If the liquid or vapor is flammable, these static electric charges must be conducted safely to ground to avoid a spark and possible explosion.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

DETAILED DESCRIPTION OF THE FIGURES

Referring now to FIG. 1, is an elevation view of one preferred embodiment of an improved transfer tank. FIG. 1 an elevation view of transfer tank 102 having roof 104, tank shell 110, internal floating roof 108, and bottom 106. FIG. 1 also shows outflow vent 122, anti-rotation device 119 for the IFR, and roof port/sleeve 124. FIG. 1 shows the internal floating roof 108 having tall sidewall 232, pressure (bleeder) vent 121, and the anti-rotation device (ARD), with wipers 231 at the circumference edge, and IFR deck 234.

Figure 2:
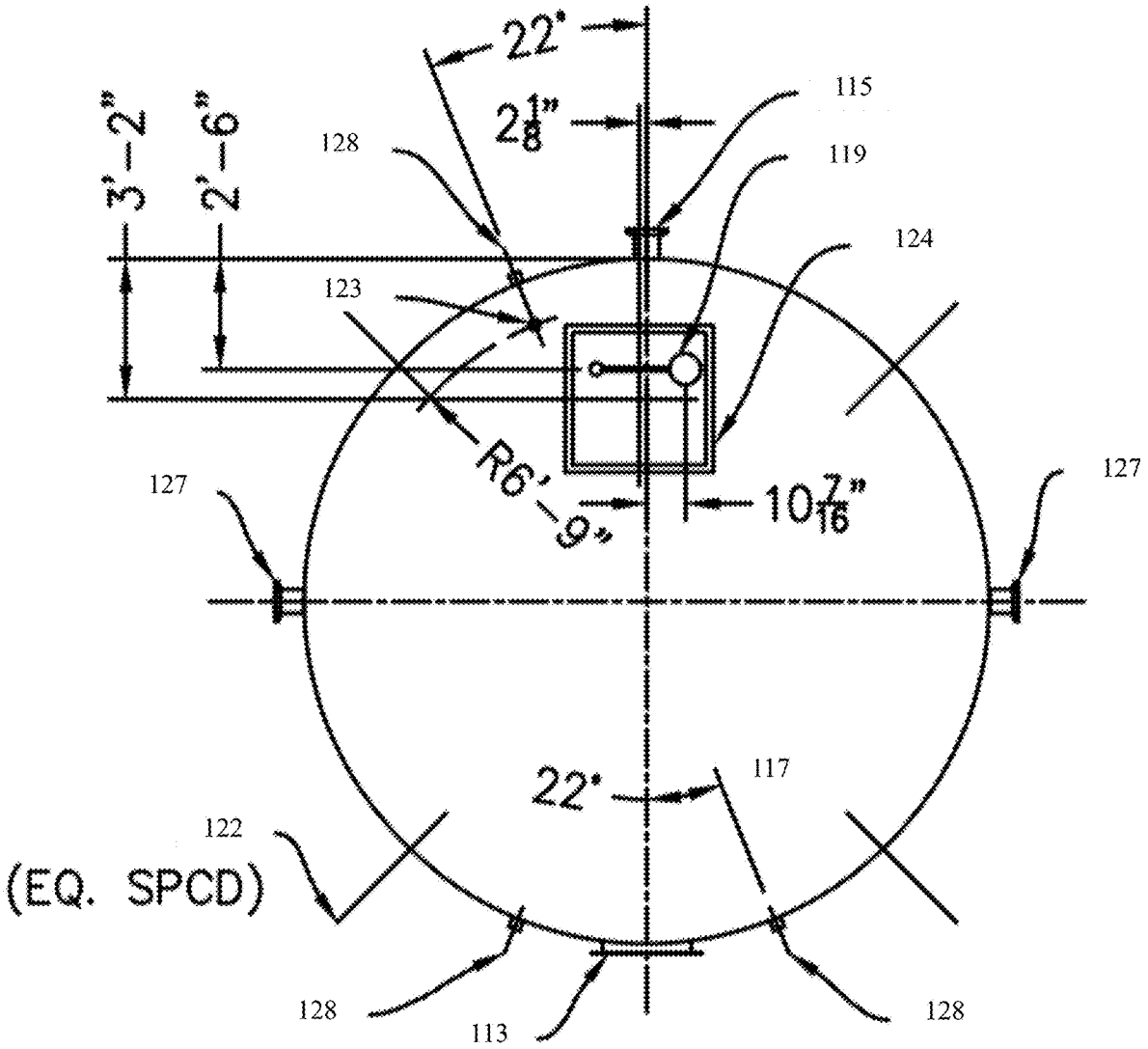
FIG. 2 is a top view of one preferred embodiment of an improved transfer tank.

FIG. 2 is a top view of one preferred embodiment of an improved transfer tank. FIG. 2 shows the orientation of the roof manway 124 relative to roof coupling 128 and hoist pegs 127. The 30" shell manway 113 is sen although not part of the roof. Outflow vent locations 122, roof coupling 123, and the ARD 119 rooftop extension is set within manway 124.

Figure 3:
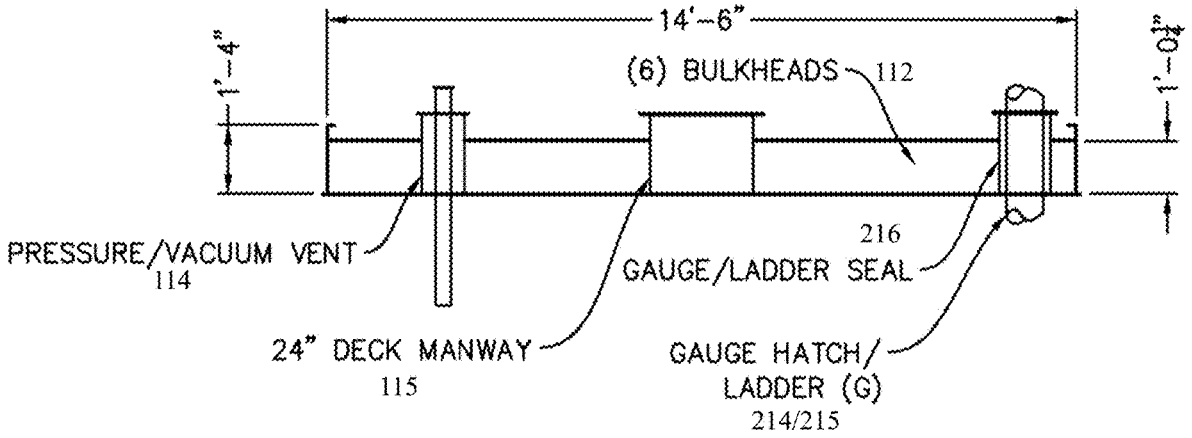
FIG. 3 is an elevation view of an improved internal floating roof.

FIG. 3 is an elevation view of an improved internal floating roof. FIG. 3 shows pressure vent 114, IFR deck manway 115, bulkheads 112, the gauge/ladder 214/215 that is part of ARD 119, and the ladder/ARD seal gasketed sleeve 216.

Figure 4:
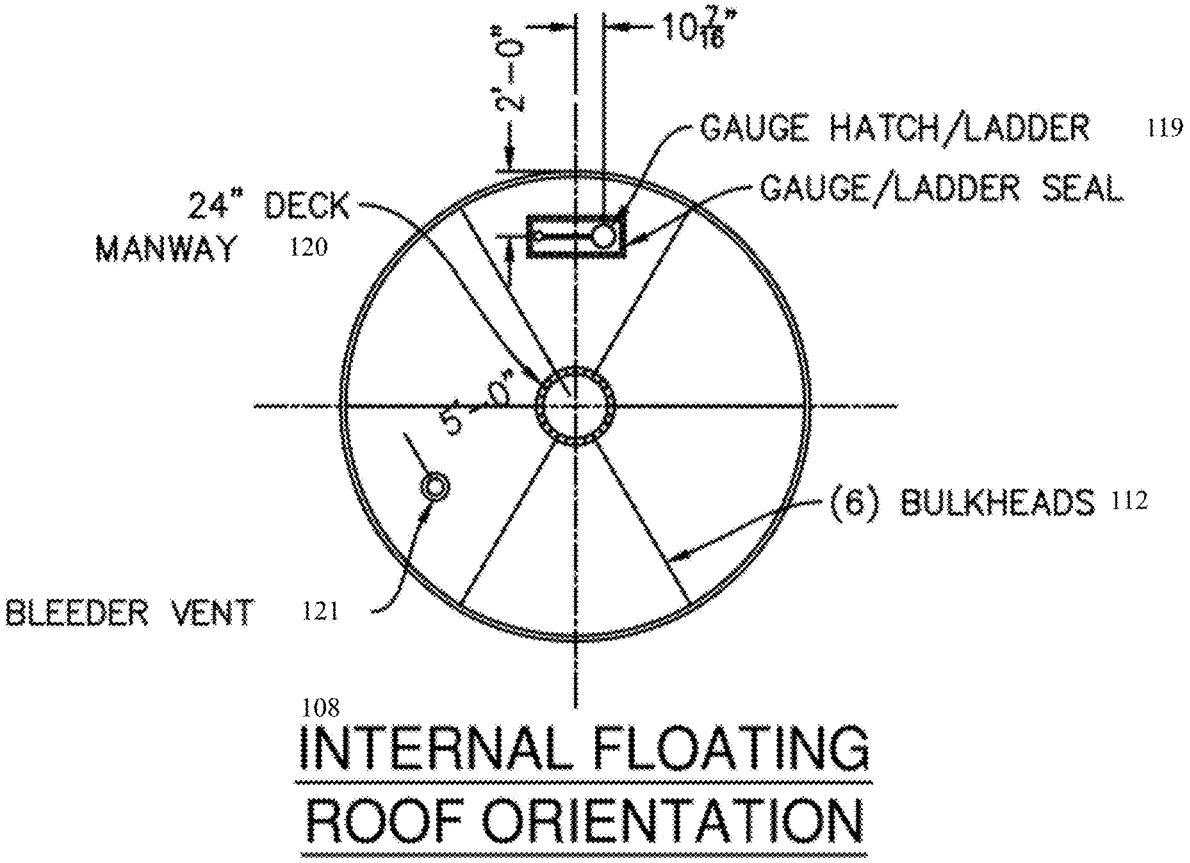
FIG. 4 is a top view of an improved internal floating roof.

FIG. 4 is a top view of an improved internal floating roof 108. FIG. 4 shows IFR deck port/sleeve 120, gauge hatch/ladder 119 (ARD), bleeder vent 121, and bulkheads 112.

Figure 5:
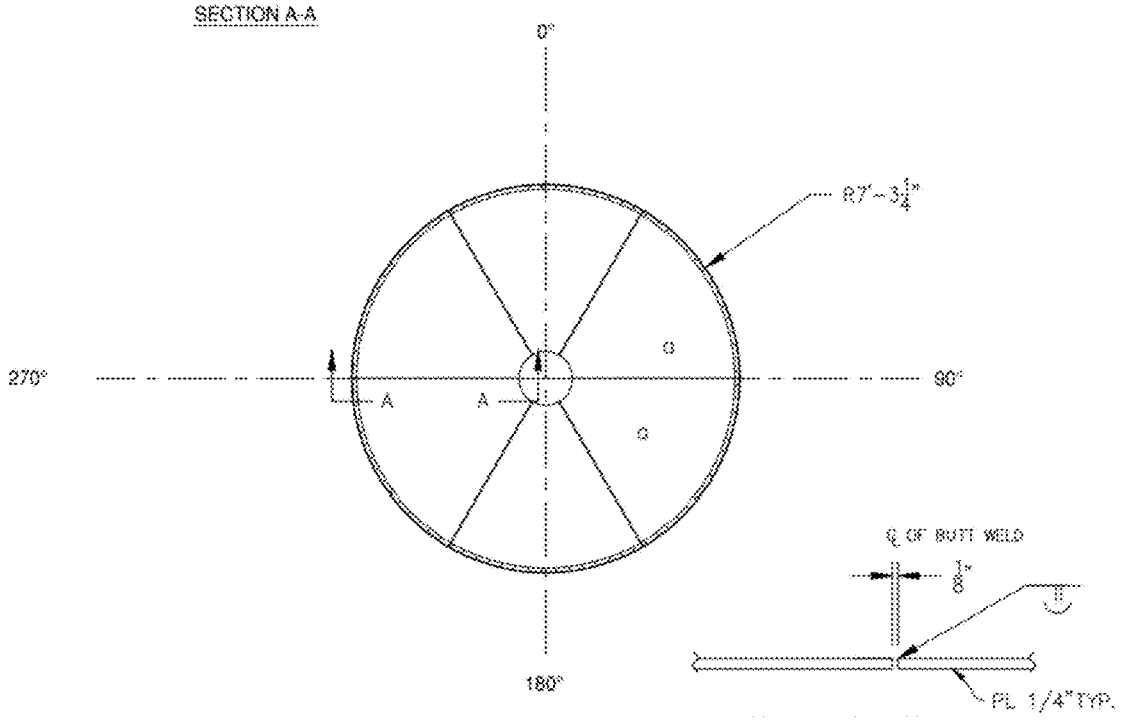
FIG. 5 is a top view of the deck, bulkheads, and sidewall of an improved internal floating roof.

FIG. 5 is a top view of the deck 120, bulkheads 112, and sidewall 232 of an improved internal floating roof 108 before the bleeder vent 121, ARD 119, and deck manway 115 are installed.

Figure 6:
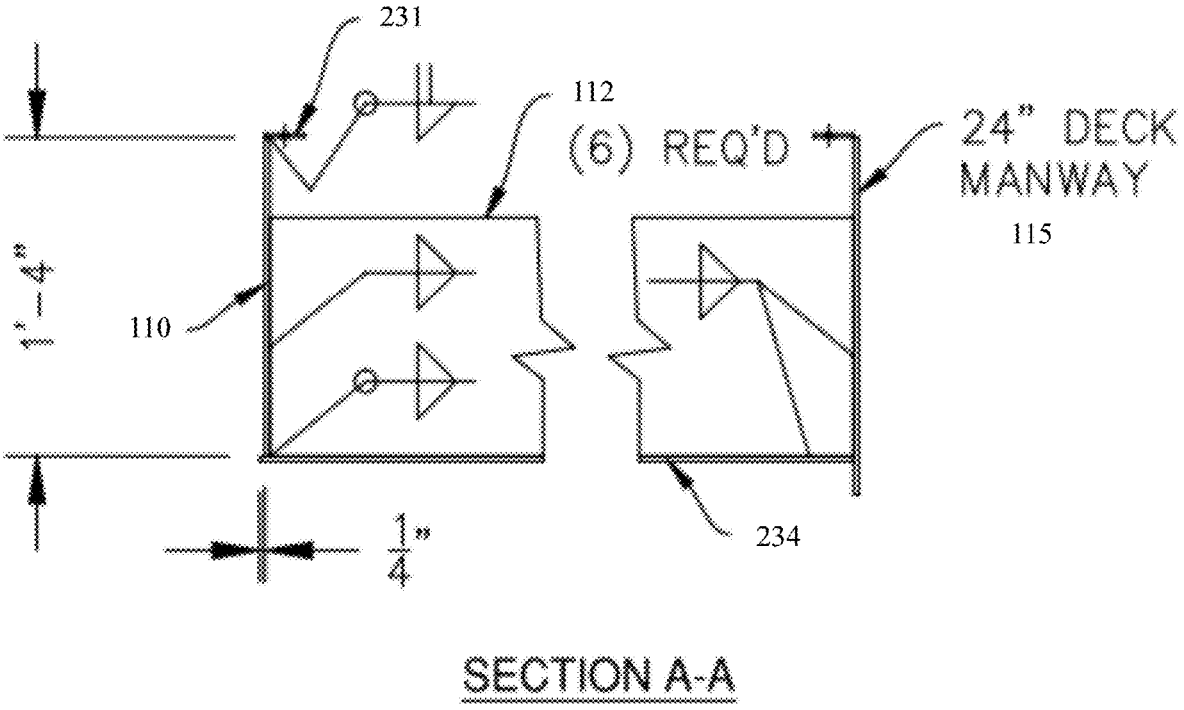
FIG. 6 is a cross-sectional view of an improved internal floating roof.

FIG. 6 is a cross-sectional view of an improved internal floating roof. FIG. 6 shows mechanical shoe seal/wiper 231 in operative contact with shell 110. IFR deck 234 and bulkheads 112 are shown connecting to central IFR deck manway 115.

Figure 7:
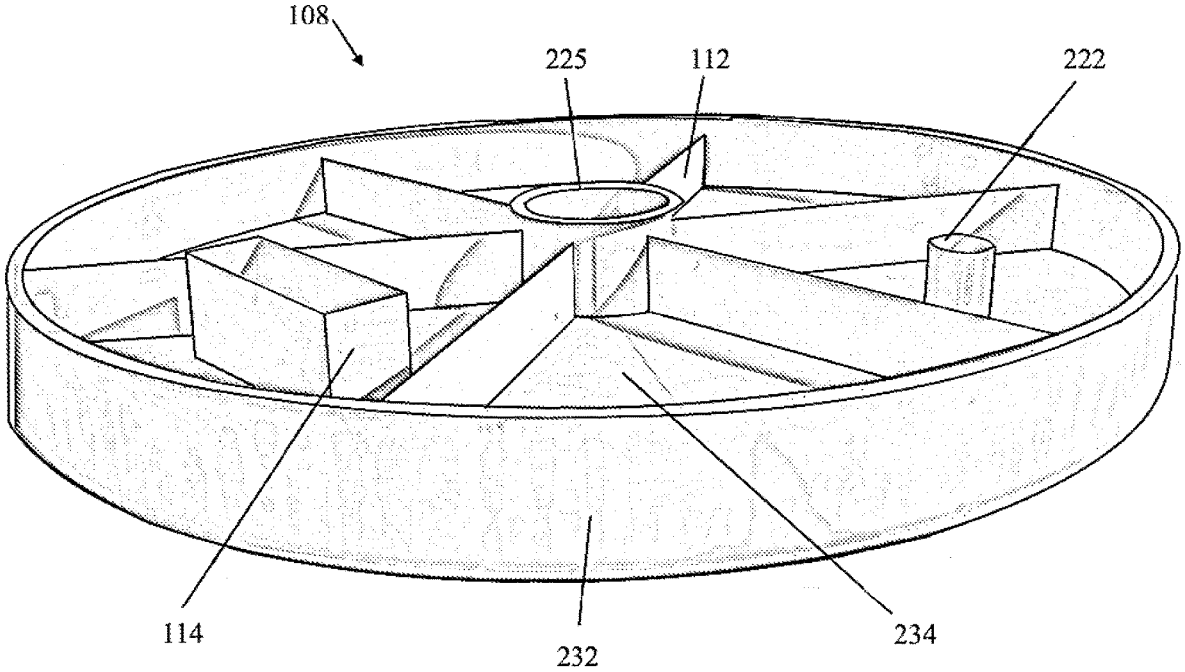
FIG. 7 is a perspective view of an improved internal floating roof.

FIG. 7 is a perspective view of an improved internal floating roof 108. FIG. 7 shows hub 225 connecting bulkheads 12 to tall sidewall 232. Sleeve 222 and ARD hatch structure gasketed port/sleeve 216 is shown attached to deck 234 of the IFR.

Figure 8:
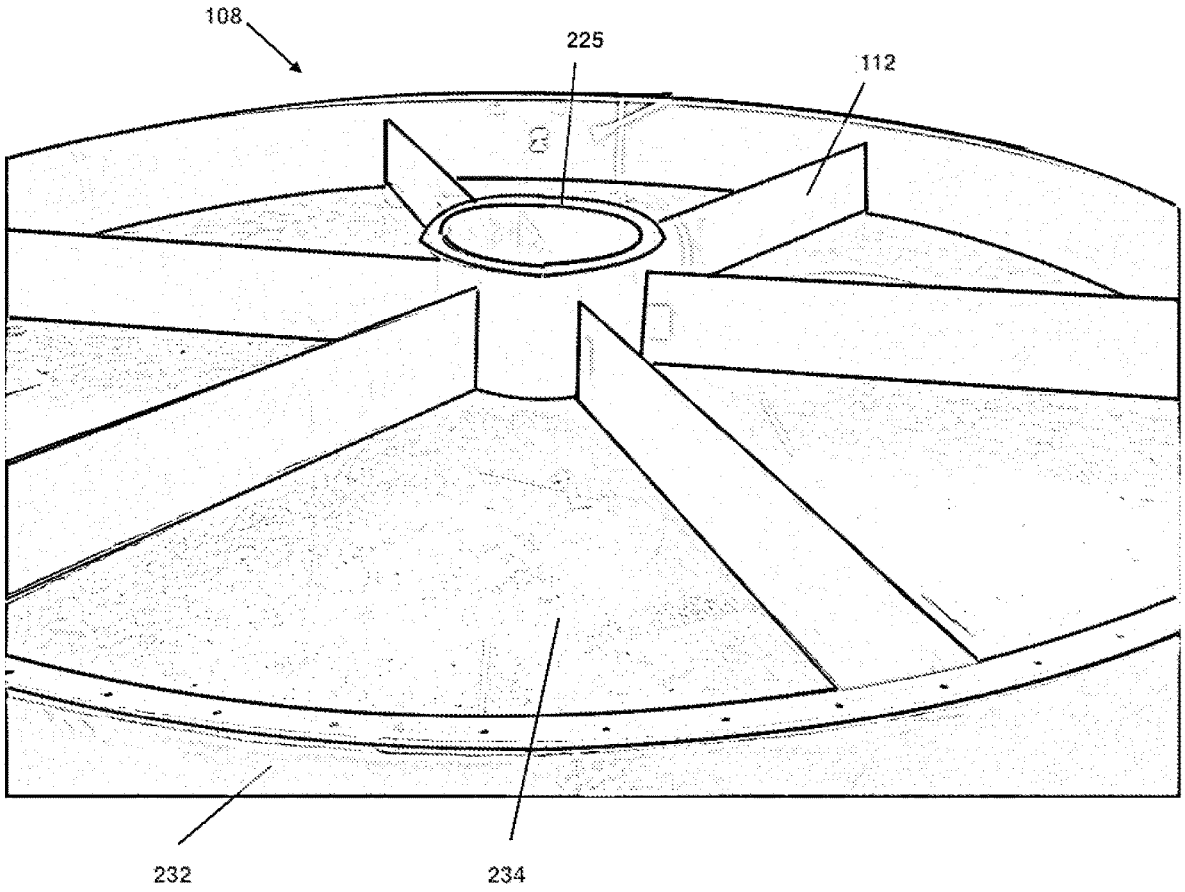
FIG. 8 is a close-up partial perspective view of the deck, bulkheads, and sidewall of an improved internal floating roof.

FIG. 8 is a close-up partial perspective view of the deck 234, bulkheads 112, and sidewall 232 of an improved internal floating roof 108 with hub 225 connecting the bulkheads 112.

Figure 9:
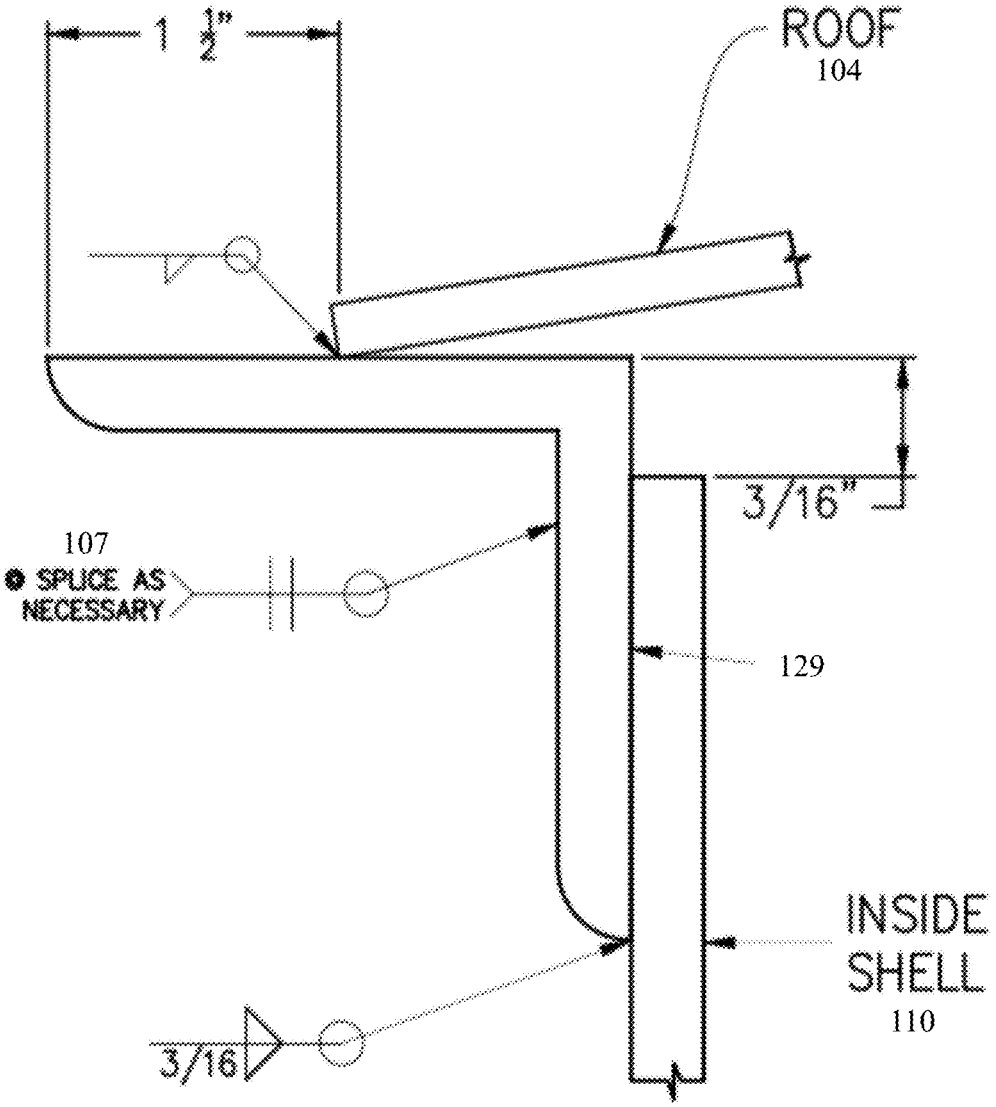
FIG. 9 is a line drawing showing the intersection of the shell and the roof.

FIG. 9 is a line drawing showing the intersection of the shell 110 and the roof 104. Splice 107 made be optionally used to connect the roof to the outside wall 129 of shell 110.

Figure 10:
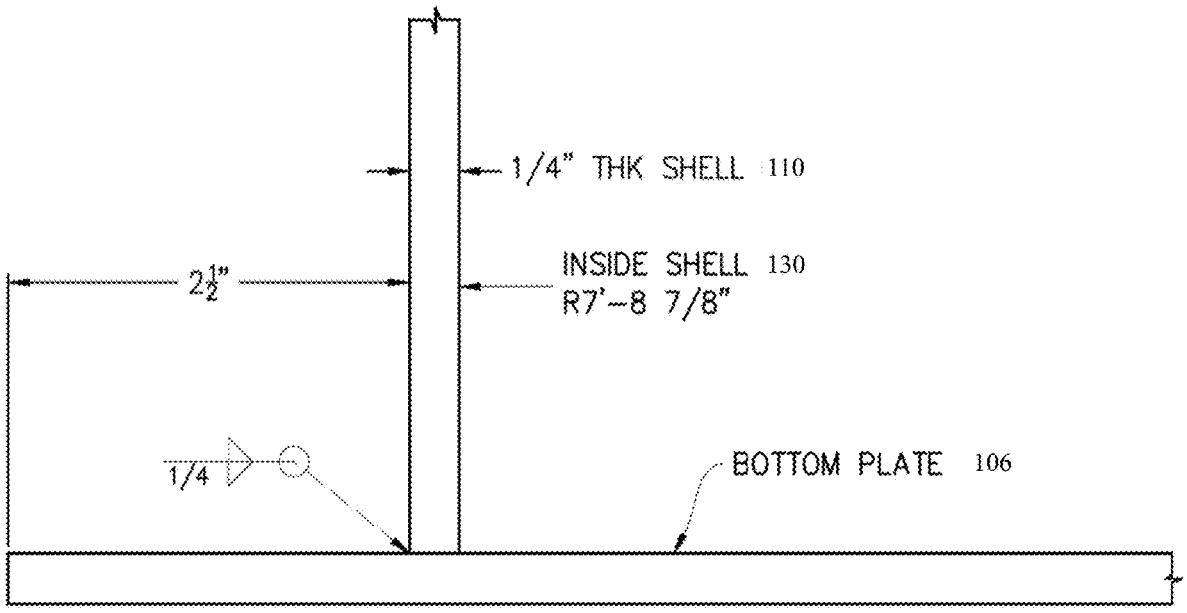
FIG. 10 is a line drawing showing the intersection of the shell and the bottom.

FIG. 10 is a line drawing showing the intersection of the shell 110 and the bottom 106, with the inside wall 130 of the shell 110.

Figure 11:
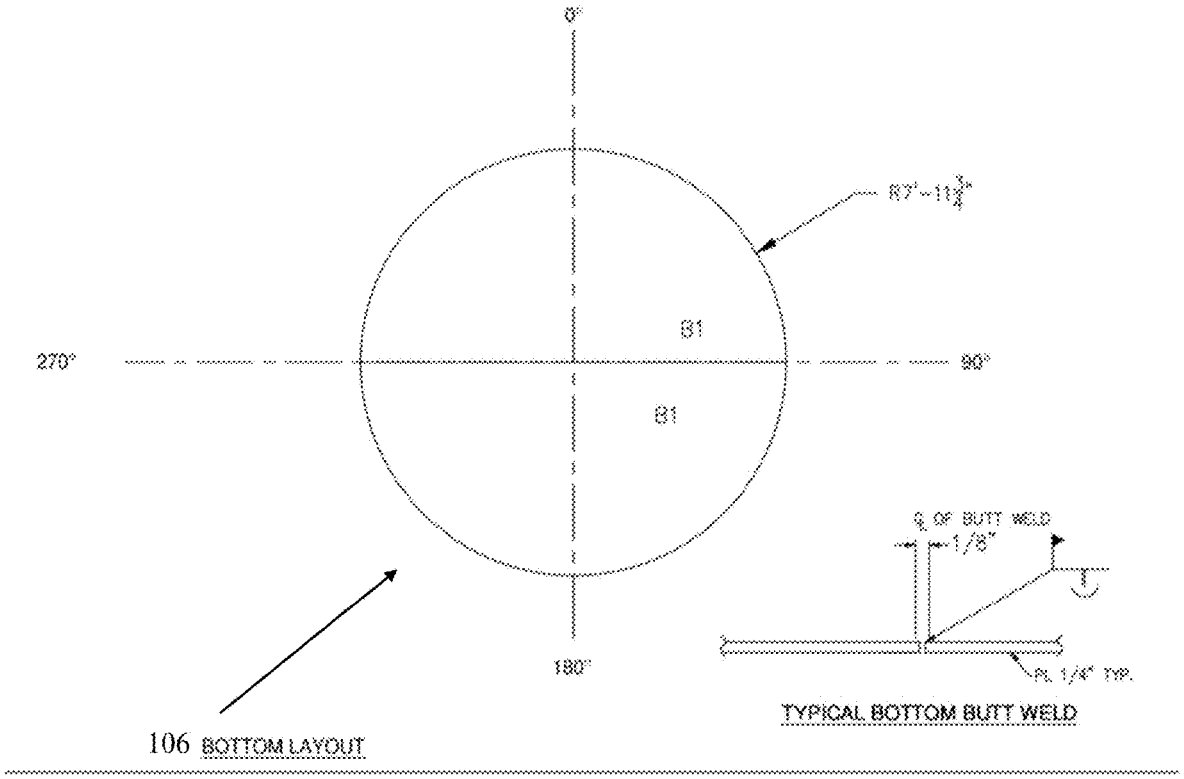
FIG. 11 is a line drawing of a top view of the bottom.

FIG. 11 is a line drawing of a top view of the bottom 106 and shows a center weld for two hemispheric halves.

Figure 12:
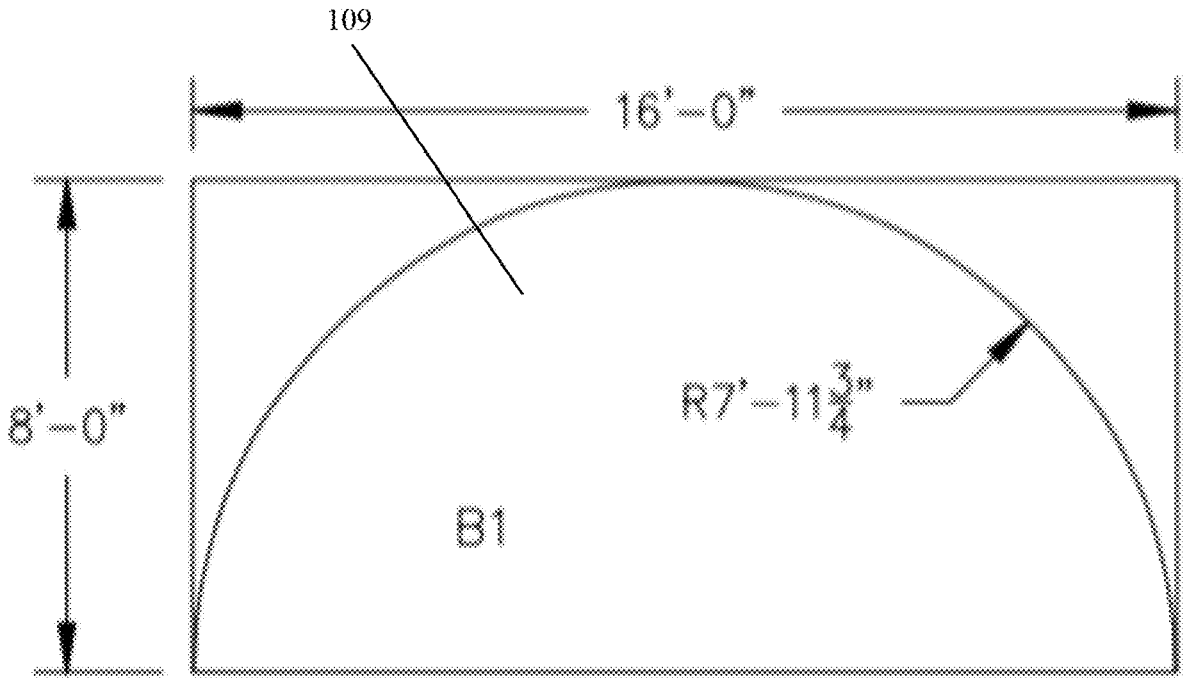
FIG. 12 is a line drawing showing a sectional half of the bottom.

FIG. 12 is a line drawing showing a sectional half 109 of the bottom plate 106.

Figure 13:
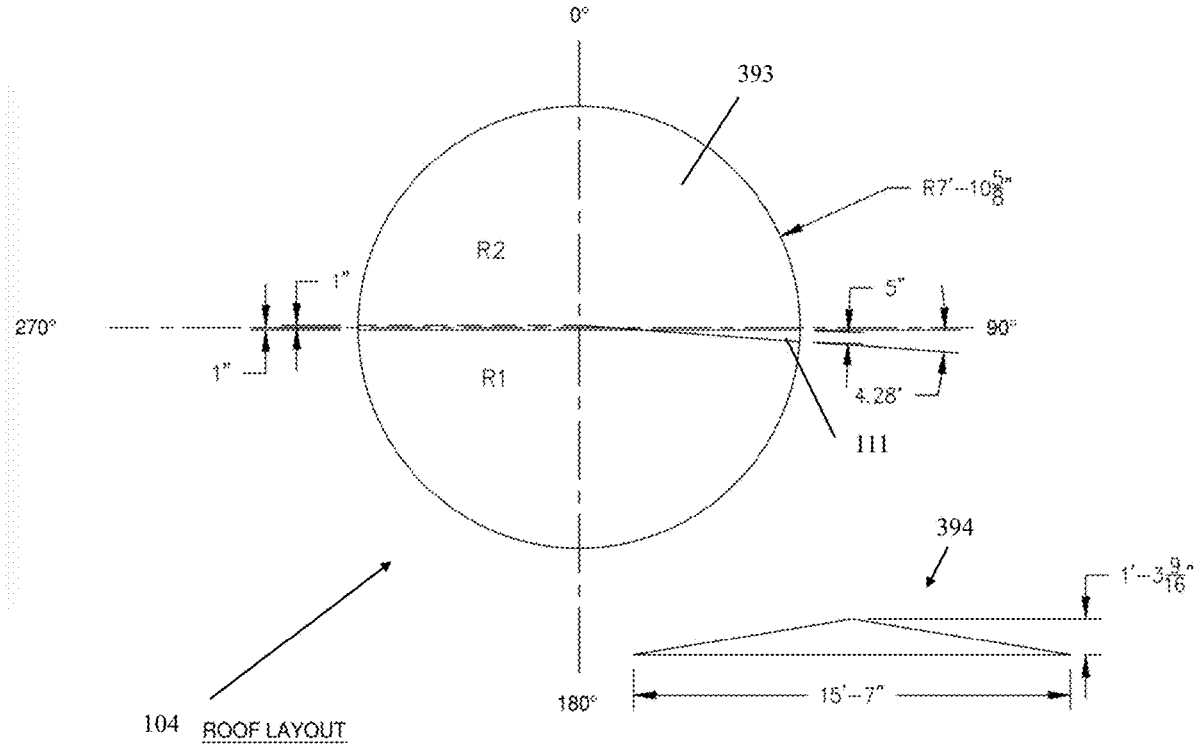
FIG. 13 is a line drawing of the top of the roof.

FIG. 13 is a line drawing of the top of the roof 104. FIG. 13 shows roof deck 393, roof cone cut 11, and roof elevation 394.

Figure 14:
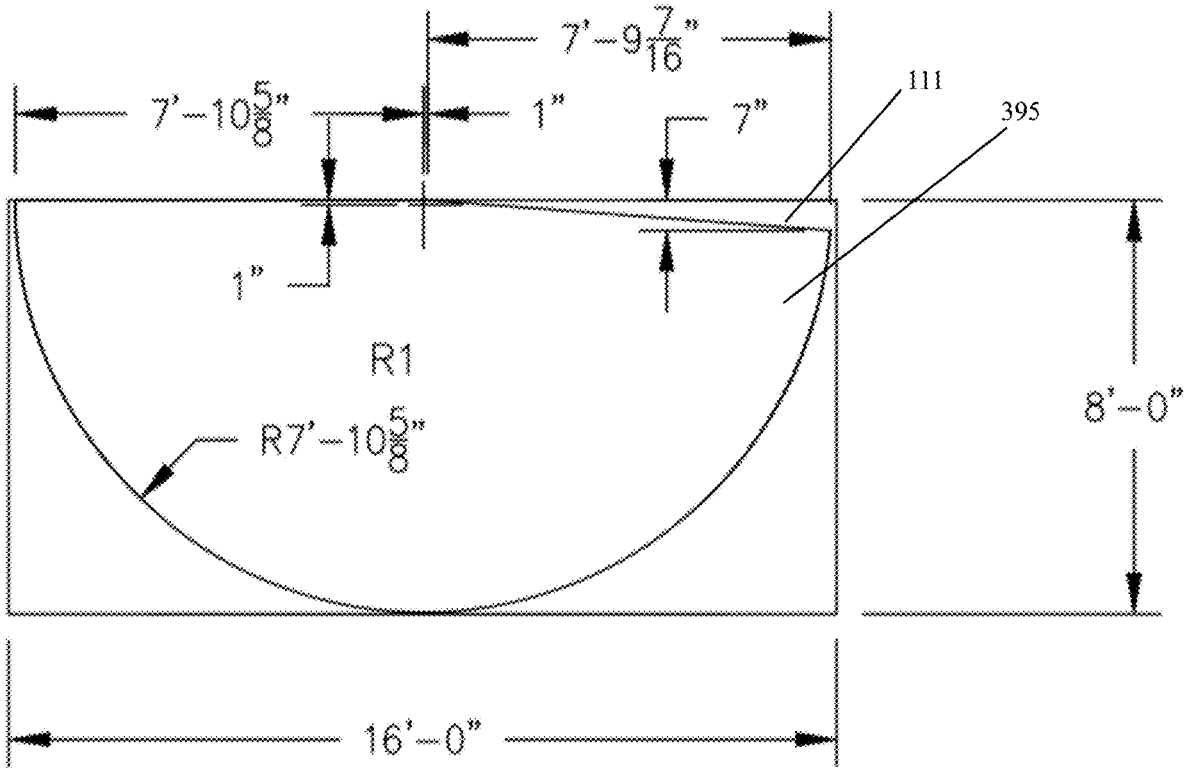
FIG. 14 is a line drawing showing a sectional half of the roof.

FIG. 14 is a line drawing showing a cone-cut sectional half 395 of the roof 104.

Figure 15:
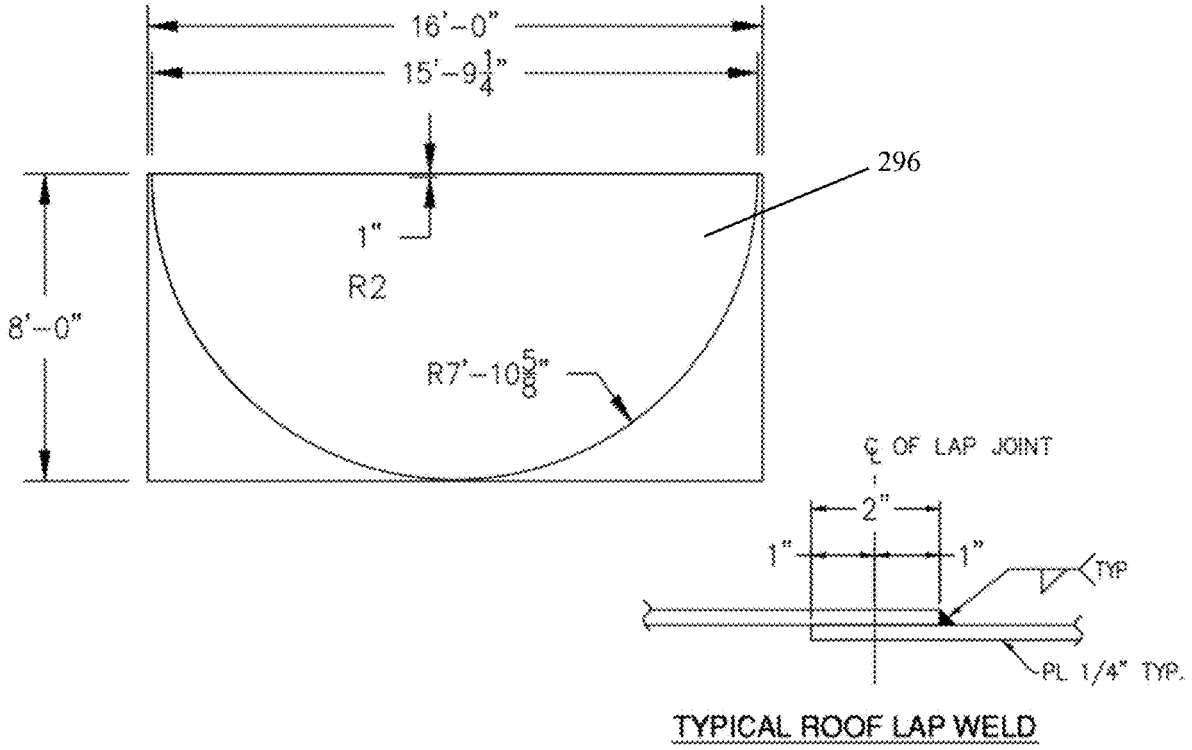
FIG. 15 is a line drawing showing a pre-weld sectional half of the roof.

FIG. 15 is a line drawing showing a pre-weld sectional half 396 of the roof 104.

Figure 16:
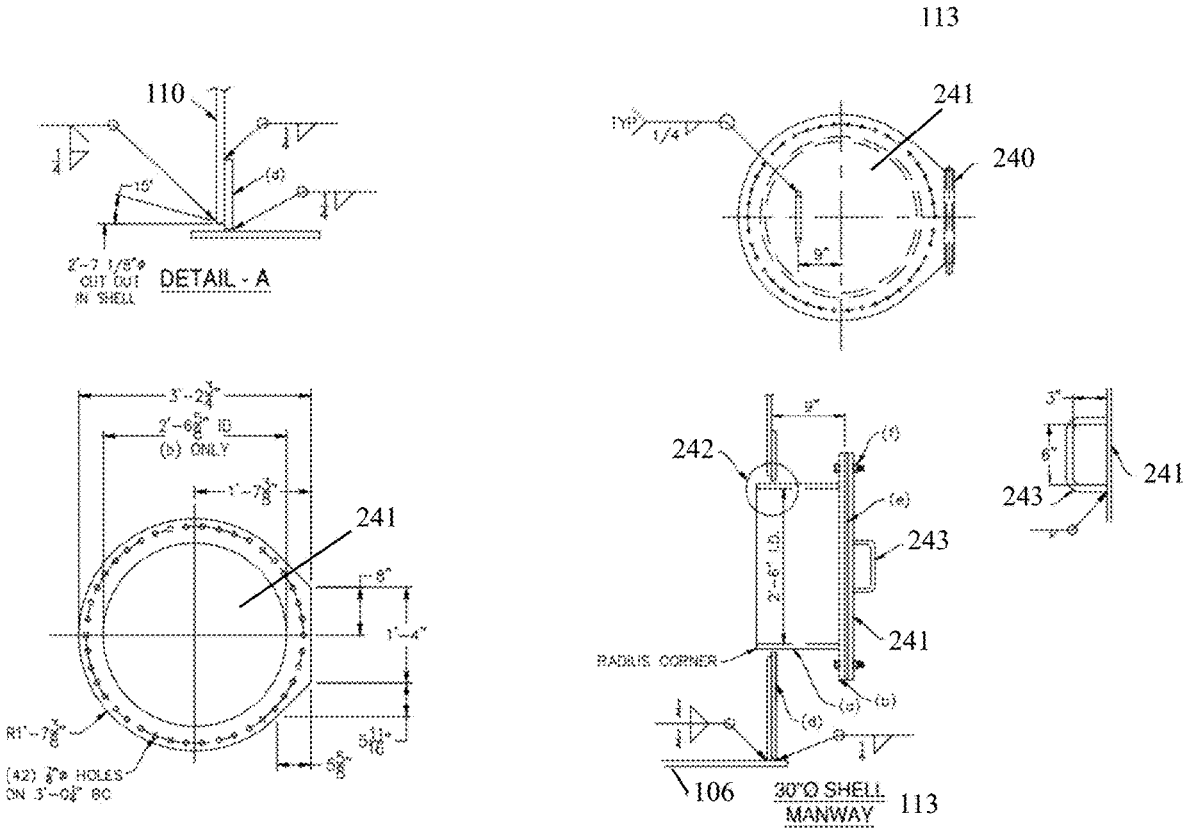
FIG. 16 is a series of line drawings of a circular manway port in the sidewall (shell) of the tank.

FIG. 16 is a series of line drawings of a circular manway port 113 in the sidewall (shell) 110 of the tank 102. FIG. 16 shows cover 21 and hinge 240 of manway port 113. FIG. 13 also shows handle 243, gasket coupling 242, and the manway 113 relative to the bottom plate 106.

Figure 17:
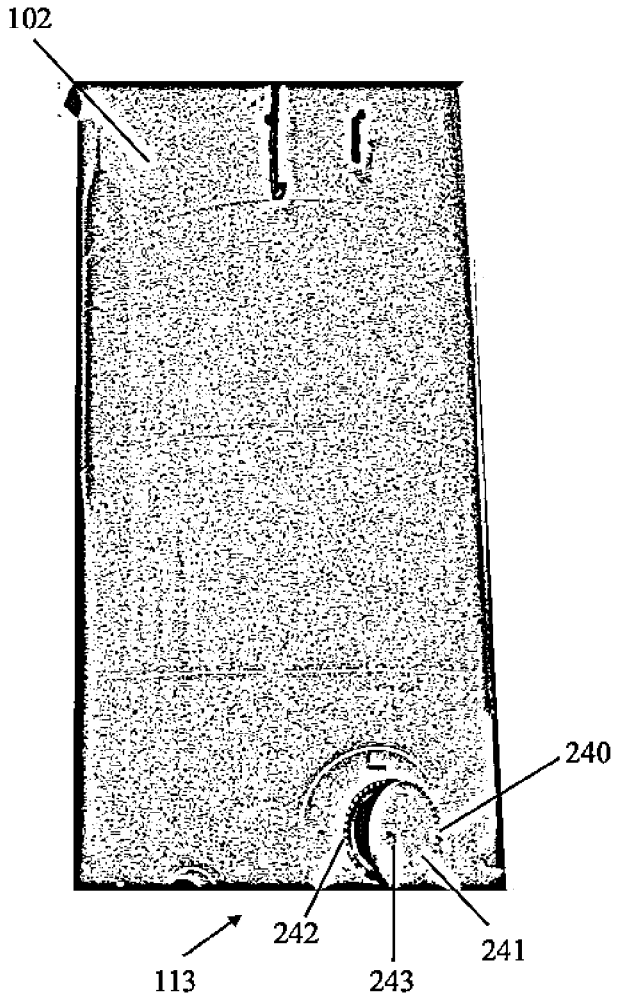
FIG. 17 is a line drawing showing a tank with a shell manway with the cover open.

FIG. 17 is a line drawing showing a tank 102 with a shell manway 113 with the cover 241 open.

Figure 18A:
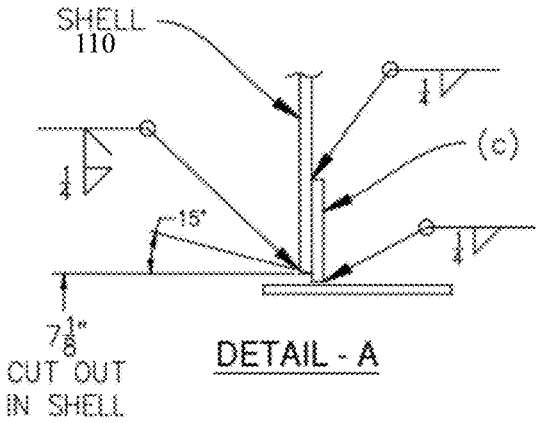
FIGS. 18A and 18B is a series of line drawings of a port in the shell.
Figure 18B:
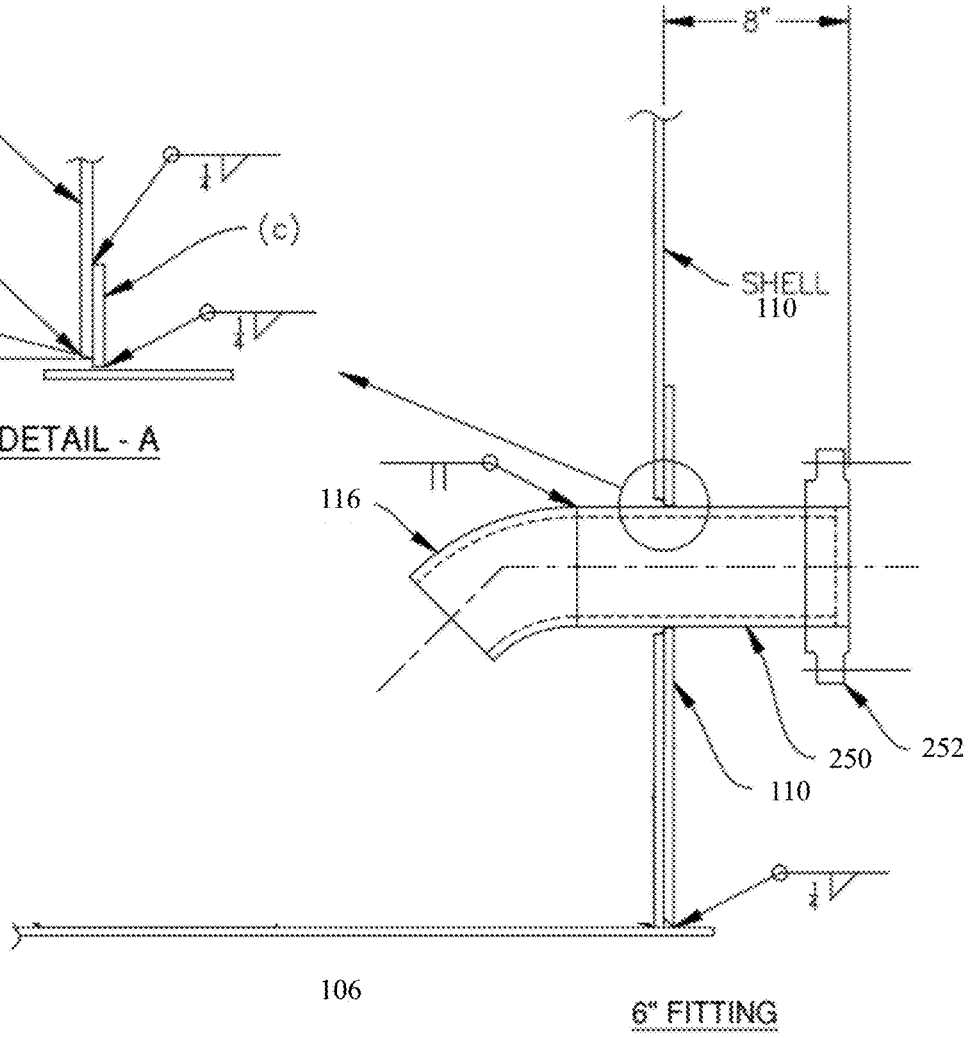

FIG. 18 is a series of line drawings of a port/pipe fitting 116 in the shell 110. FIG. 18 also shows pipe 250, cover 252, and the fitting 116 relative to the bottom plate 106.

Figure 19:
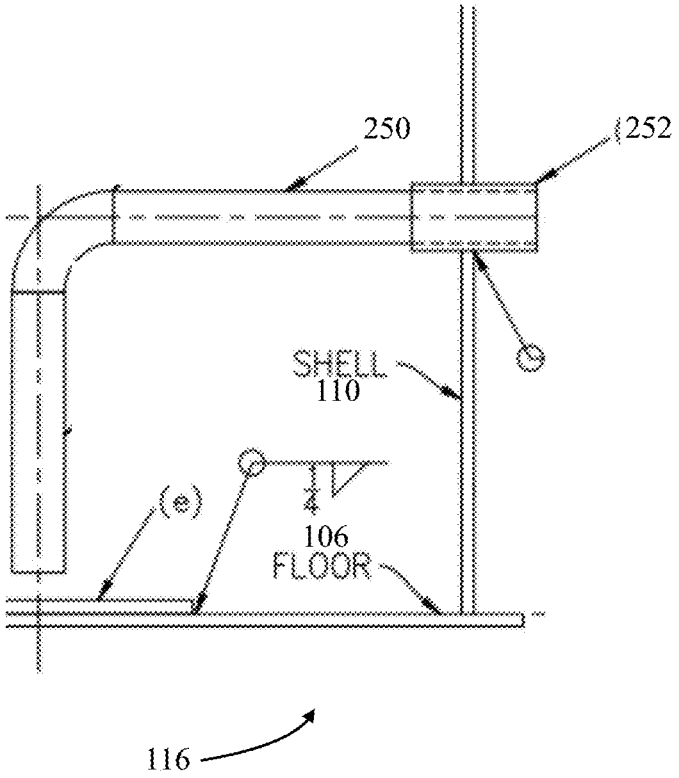
FIG. 19 is a drawing of a port with coupling in the shell near the bottom.

FIG. 19 is a drawing of another example of a port/pipe fitting 116 with pipe 250, and coupling 252 in the shell 10 near the bottom 106.

Figure 20:
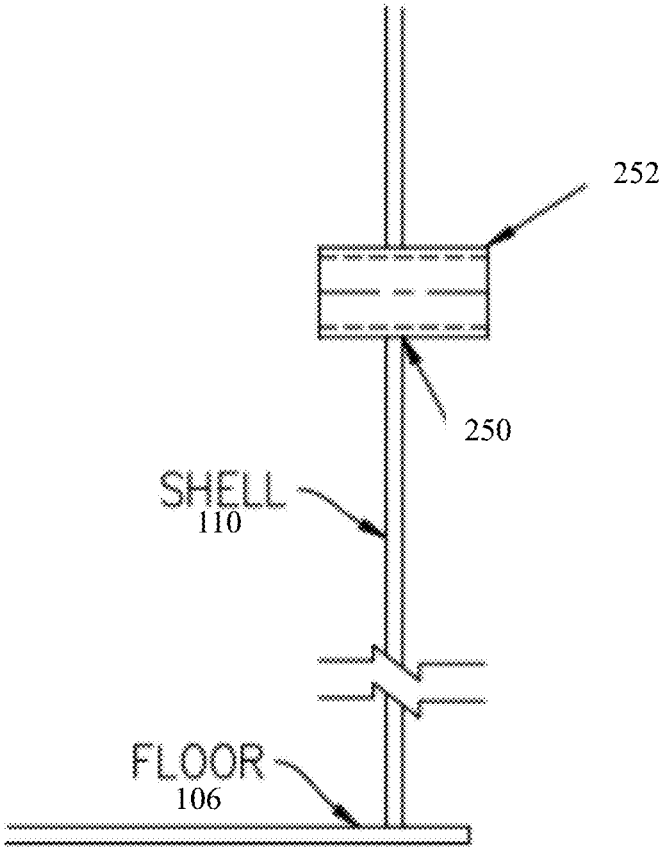
FIG. 20 is a line drawing of a detail of a coupling in the shell.

FIG. 20 is a line drawing of another example of a detail of a coupling 252 for a pipe 250 in the shell 110.

Figure 21:
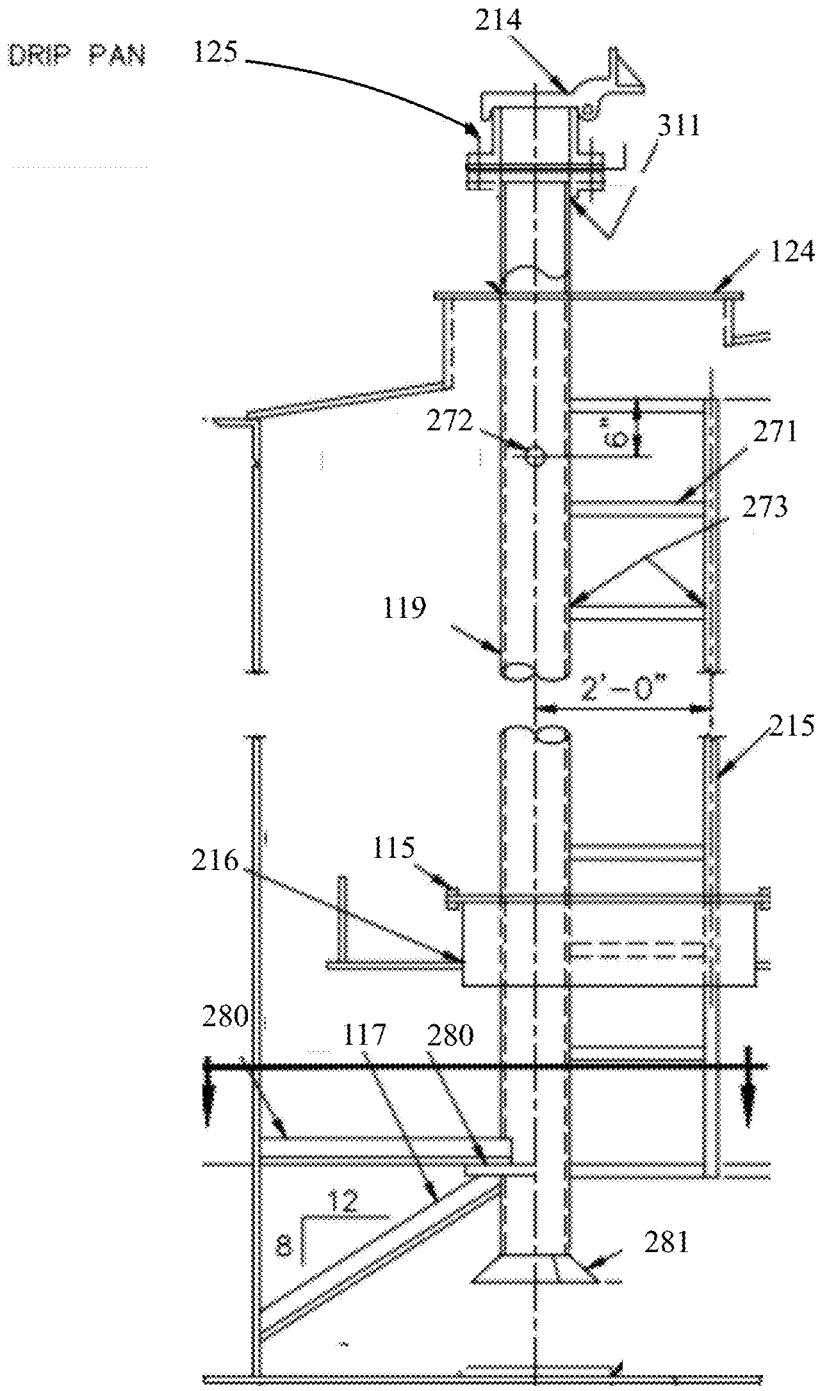
FIG. 21 is a line drawing showing a cross-sectional view of a tank with the internal anti-rotation device mounted within a cone platform near the bottom and extending vertically within the tank and extending through the roof deck.
Figure 22A:
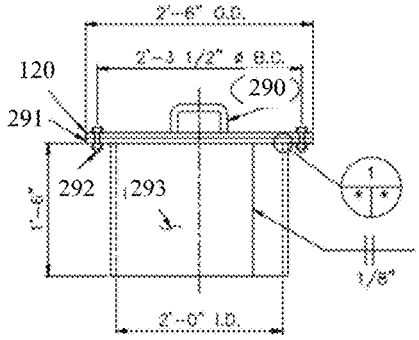
FIG. 22A, 22B, 22C, 22D is a series of line drawings of a manway port in the roof deck.
Figure 22B:
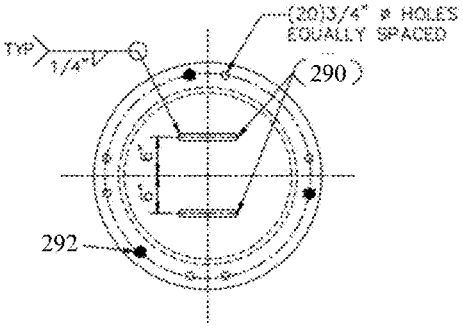
Figure 22C:
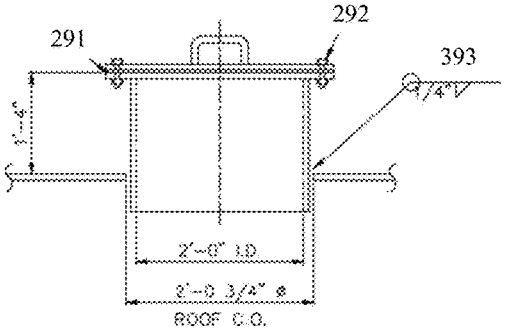
Figure 22D:
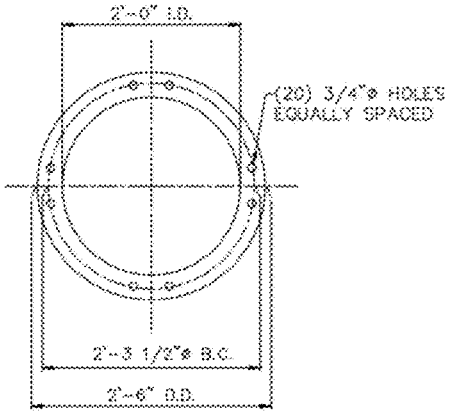

FIG. 21 is a line drawing showing a cross-sectional view of a tank 102 with the internal anti-rotation device 119 mounted to the floor of the tank. An optional a cone support platform 117 near the bottom can support deck legs or a shelf. Drip pan 125 is shown near ARD roof hatch 214, and gasket 311. Thru hole 272 is seen in pipe 270 which is part of ARD 119. Ladder 215 has rungs 271 connected by rung connectors 273. Internal floating roof 108 shows IFR deck manway 115, and ladder seal 216. Shelf 280 in cone support 117 can optionally house the IFR ARD footer 281.

FIG. 22 is a series of line drawings of a manway port 120 in the roof deck 393. FIG. 22 shows handle 290, gasket 291, bolts 292, and coupling 293.

Figure 23:
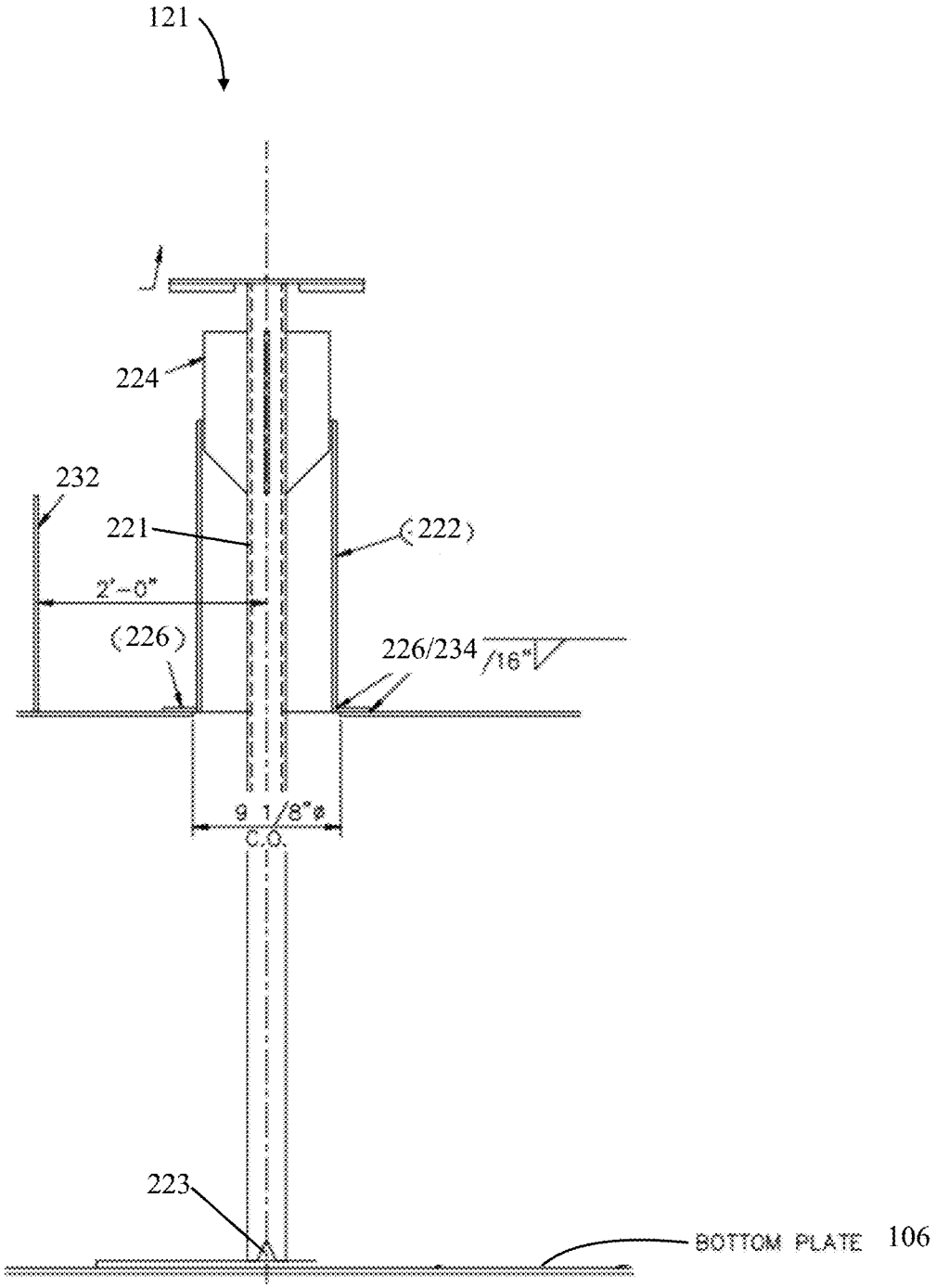
FIG. 23 is a series of line drawings of a pressure (bleeder) vent having a pipe extending from a notched portion near the bottom through a gasketed portion of the internal floating roof to a position raised above the IFR deck.

FIG. 23 is a series of line drawings of a pressure (bleeder) vent 121 having a pipe 221 extending from a notched portion 223 near the bottom 106 through a gasketed portion 224 of the internal floating roof 108 to a position raised above the IFR deck 234. Sidewall 232 connects to deck 234, and seal 226 removes any gaps.

Figure 24A:
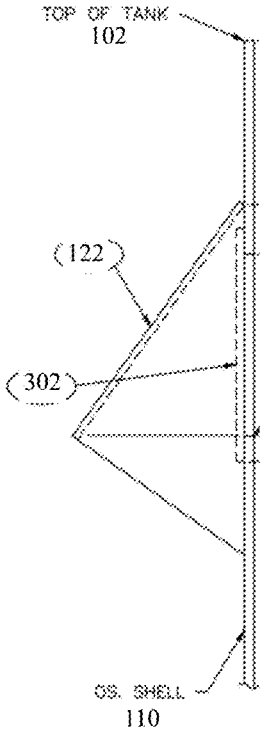
FIGS. 24A and 24B is a series of line drawings of the overflow vent mounted in the shell near the roof.
Figure 24B:
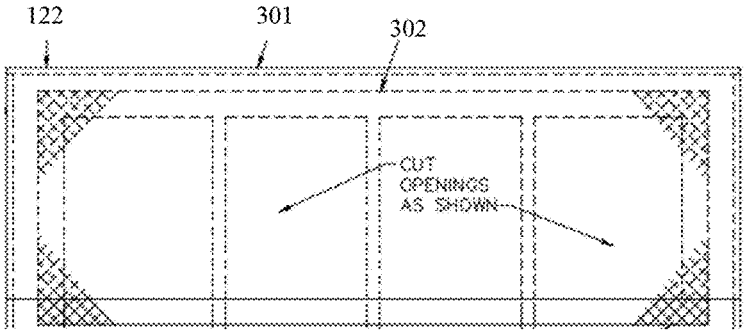

FIG. 24 is a series of line drawings of the overflow vent 122 mounted in the shell 110 near the roof 104 of tank 102. Seal 301 and wire screen 302 are shown with outflow vent 122.

Figure 25A:
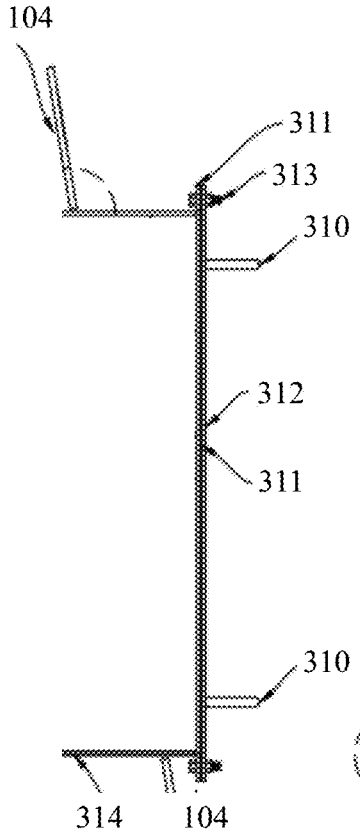
FIGS. 25A and 25B is a series of line drawings of the roof manway.
Figure 25B:
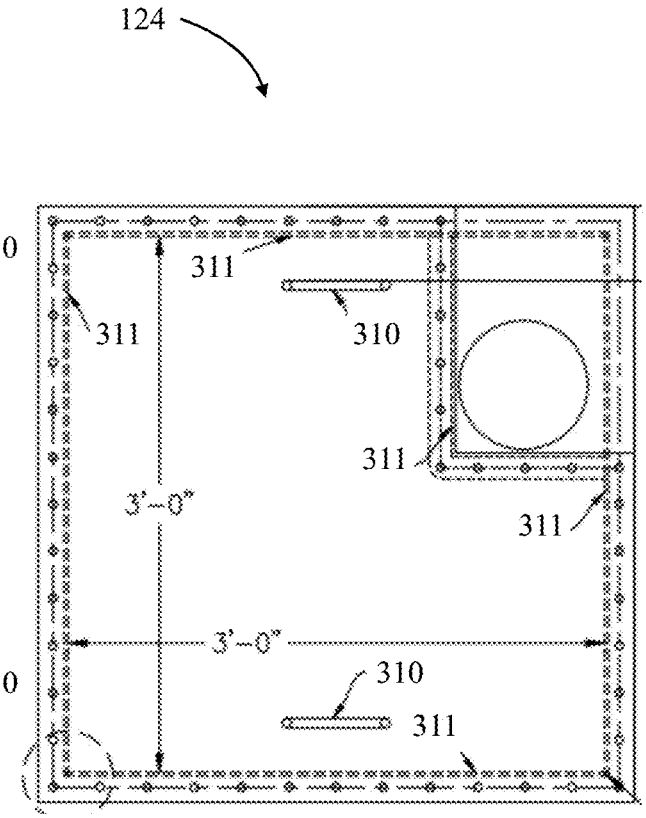

FIG. 25 is a series of line drawings of the roof manway 124. FIG. 25 shows roof 104 in vertical elevation view with handles 310, gasket 311, cover 312, bolts 313, and coupling sleeve 314.

Figure 26:
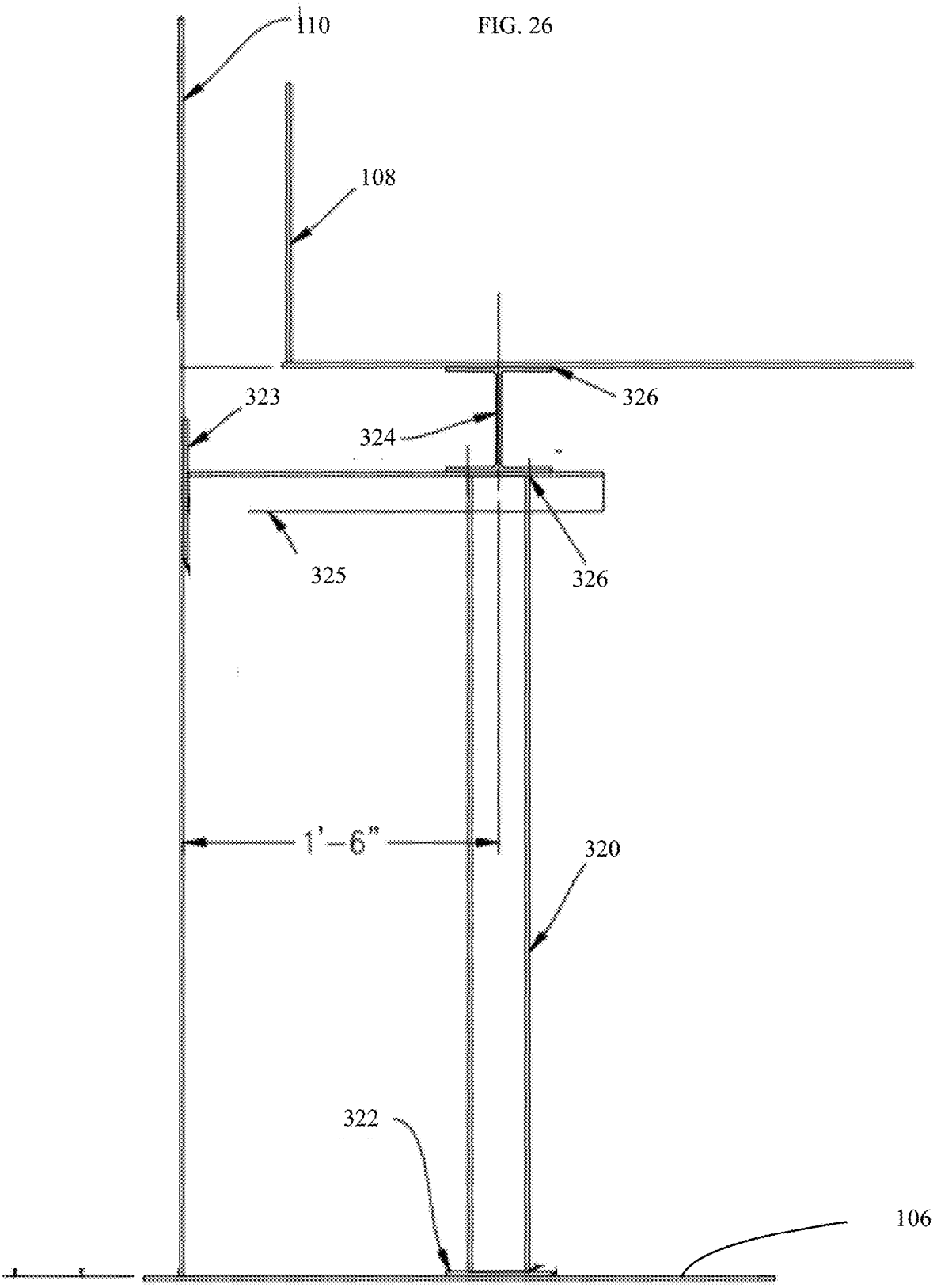
FIG. 26 is a line drawing of the deck legs attached to the bottom within the tank for securing the IFR during transport.

FIG. 26 is a line drawing of the deck legs 126 attached to the bottom 106 within the tank for securing the IFR 108 during transport. FIG. 26 shows shell 110 with shell connection 323 ataching lateral support 325 to pipe 320. IFR connection 324 and bolts 326 connect the IFR deck 234 to the deck legs 126. Footer 322 is attached to bottom 106. Deck legs are removed during operation/use of the tank as a storage container.

Figure 27:
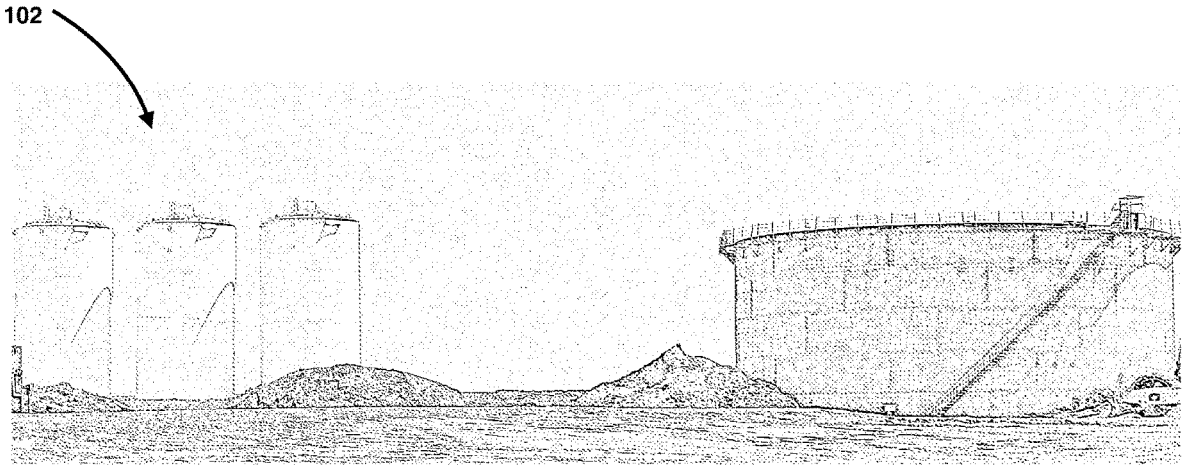
FIG. 27 is a line drawing comparing a cluster of improved transfer tanks next a traditional large storage tank.

FIG. 27 is a line drawing comparing a cluster of improved transfer tanks next a traditional large storage tank.

Figure 28:
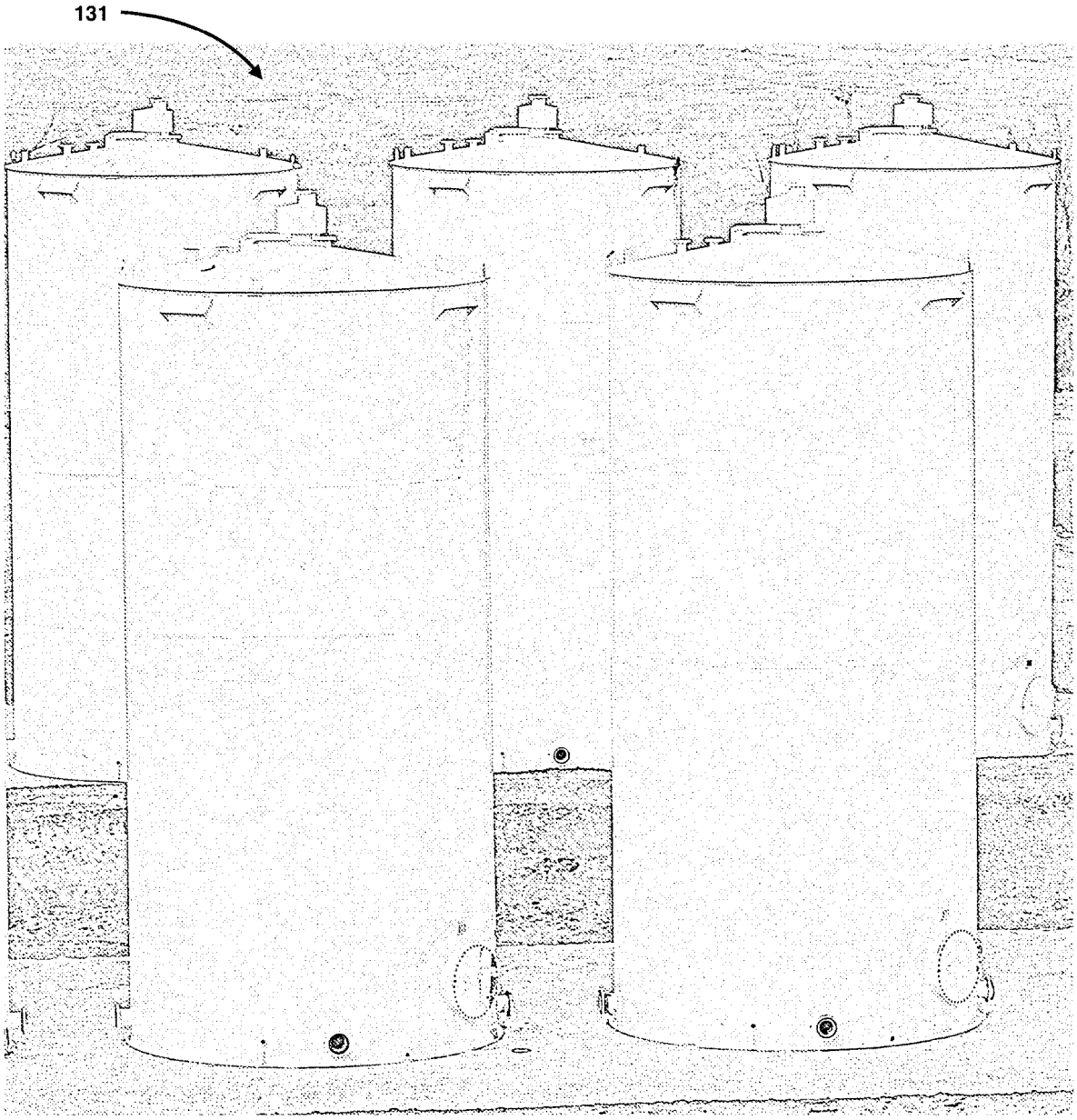
FIG. 28 is a line drawing of a cluster of improved transfer tanks.

FIG. 28 is a line drawing of a cluster 131 of improved transfer tanks.

Figure 29:
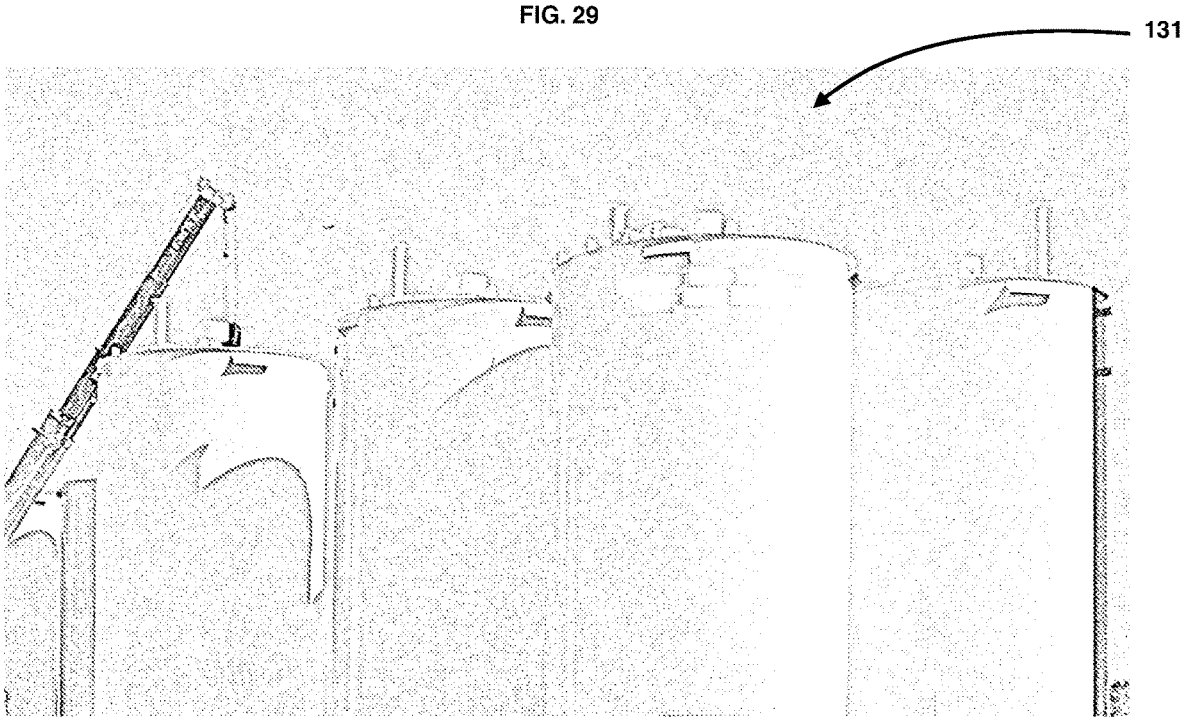
FIG. 29 is a line drawing of a crane inserting a new tank within a cluster of improved transfer tanks.

FIG. 29 is a line drawing of a crane inserting a new tank within a cluster 131 of improved transfer tanks.

Figure 30:
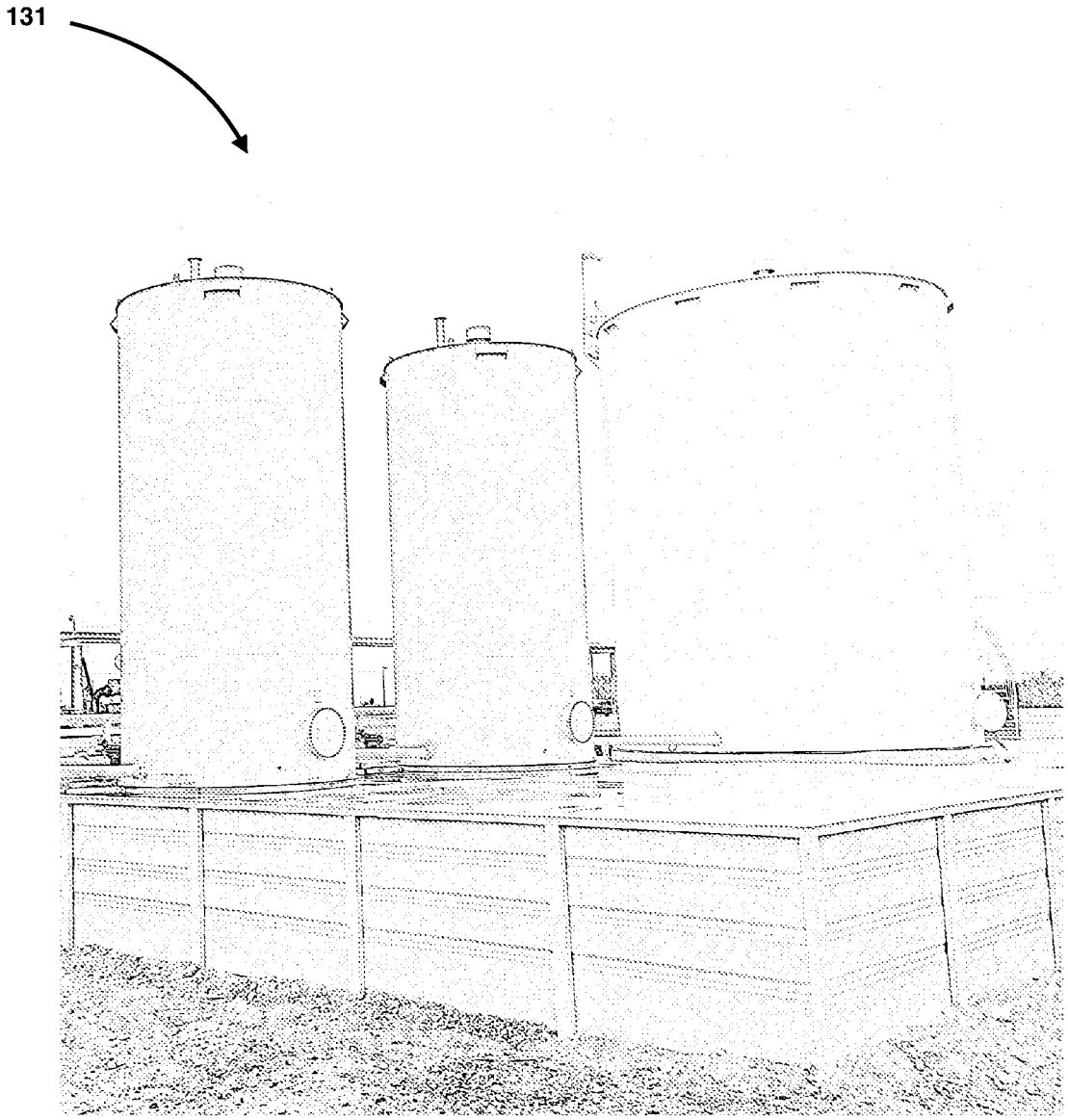
FIG. 30 is a line drawing of a cluster of tanks having a variety of sizes store within a single spill yard.

FIG. 30 is a line drawing of a cluster 131 of tanks having a variety of sizes store within a single spill yard.

Figure 31:
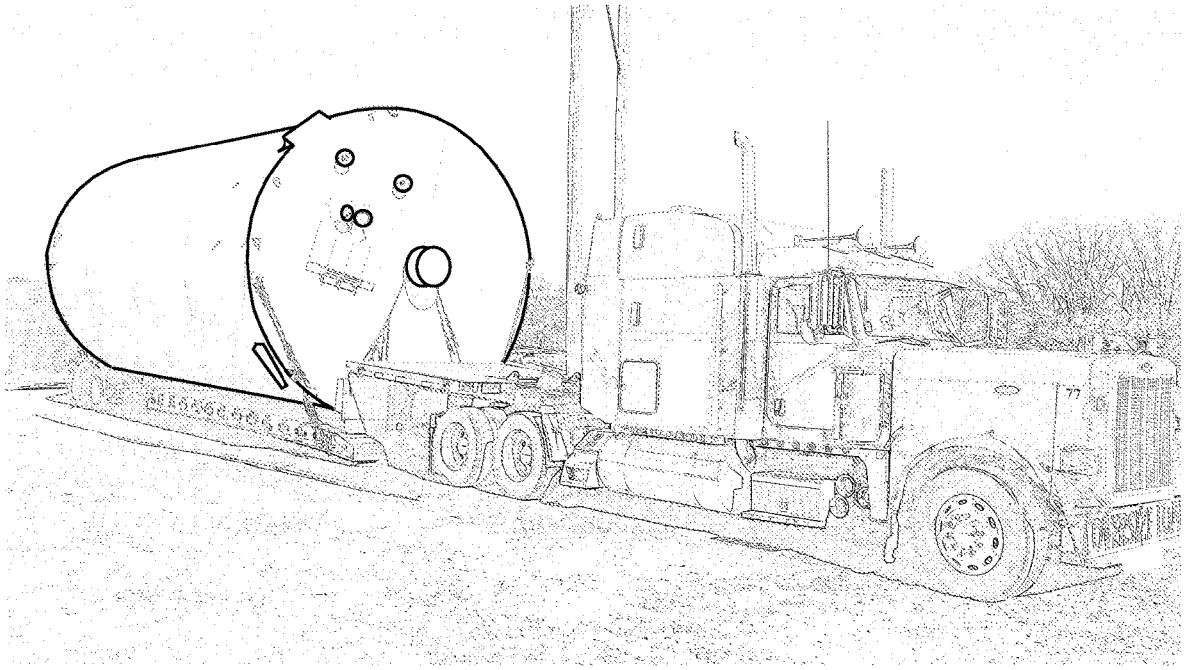
FIG. 31 is a line drawing of an improved transfer tank being transported by truck.

FIG. 31 is a line drawing of an improved transfer tank 102 being transported by truck.

Figure 32:
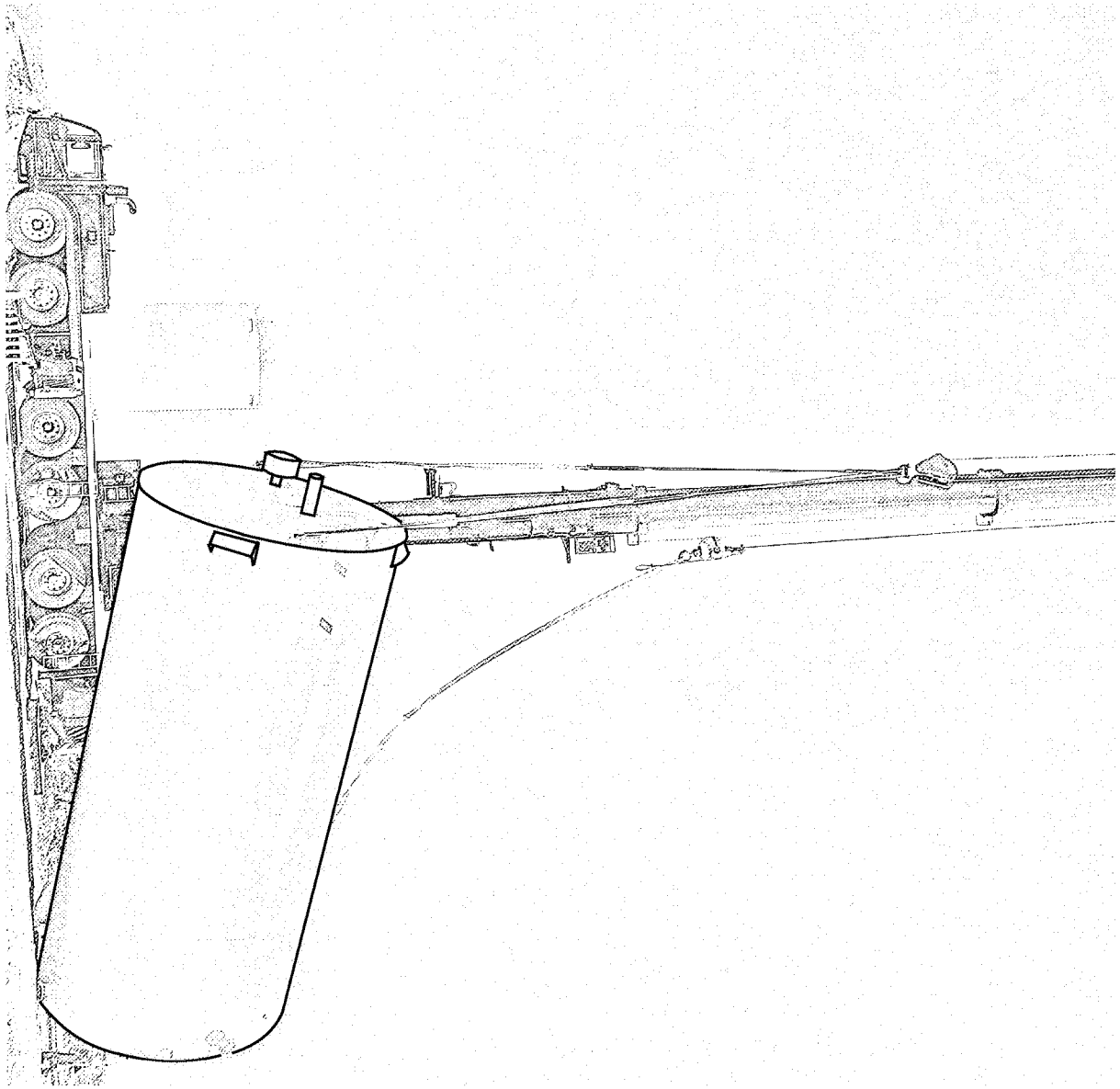
FIG. 32 is a line drawing of an improved transfer tank being lifted by crane into position.

FIG. 32 is a line drawing of an improved transfer tank 102 being lifted by crane into position.

Figure 33:
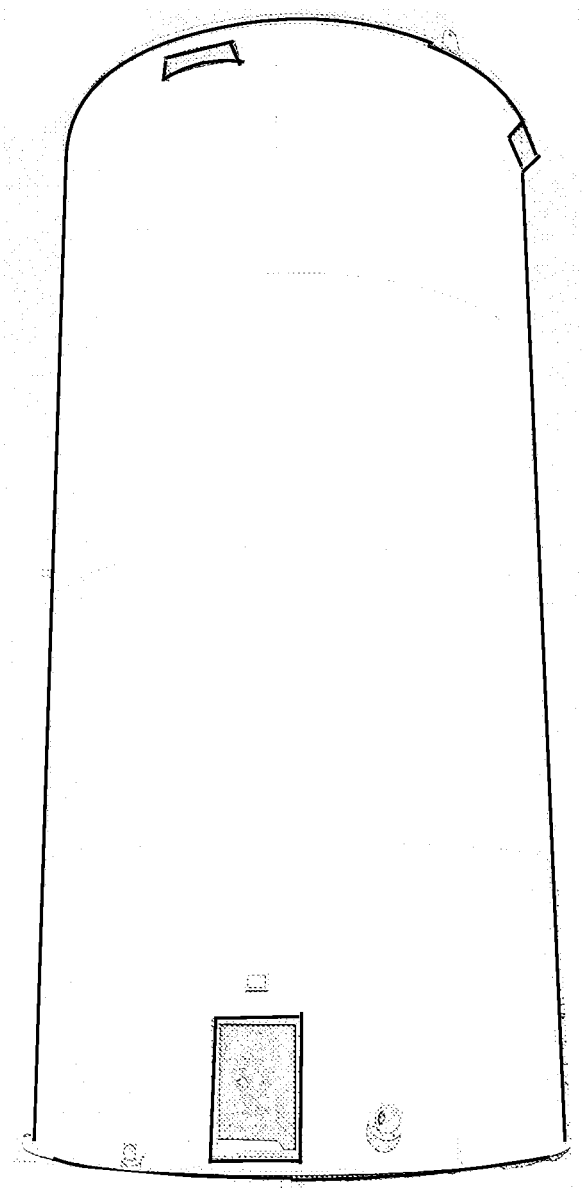
FIG. 33 is a line drawing of a single tank showing the square maintenance manway port in an open position with the cover removed.

FIG. 33 is a line drawing of a single tank 102 showing an example of square maintenance manway port in an open position with the cover removed.

One or more access ports or doorways are formed in the roof or outer wall of the tank. Persons may enter the vapor space through such access port(s) to service the tank, the floating roof and any equipment housed inside the tank.

Special precautions are taken when introducing equipment into the internal volume of the floating roof storage tank when the tank volume holds a flammable liquid, such as gasoline. Measures are taken to prevent sparks and associated combustion of flammable vapors. Measures are also taken to minimize the amount of time the seal between the flammable liquid and the vapor space above the floating roof is broken to prevent substantial amounts of flammable vapors from being emitted into the vapor space.

The floating roof frequently is provided with an opening or hatchway for access to the internal tank volume under the floating roof. That hatchway is covered with a hatch door that is sealed when closed to prevent unintended release of vapors. The hatch door also may be provided with grounding means to minimize the possibility of a spark.

Floating roof storage tanks are inspected at regular intervals to locate cracks, corrosion or other defects that might lead to tank failure. Environmental protection regulations specify the frequency and recommended procedures for inspecting tanks for structural integrity.

Assembly

The transfer tanks herein are assembled using the following steps:

1. The tank bottom is cut from two pieces of welded steel to form a circular plate. This circular plate must be a nearly perfect circle. The plates can be welded before or after, but preferably are cut after being welded together to avoid offsetting during the welding of the two hemispheres.

2. The first portion of the shell wall is attached to the bottom plate, creating an open cylinder.

3. Deck support leg(s) are welded to the floor/bottom plate.

4. A second rigid circular plate is constructed, again being nearly a perfect circle and having a diameter slightly less then the inner diameter of the cylinder formed in step. 2.

5. The second circular plate has a vertical side wall is attached around the circumference, the vertical sidewall has one or more annular seals attached to the its outer surface, bulkhead support beams are attached to the surface (deck) of the second circular plate, and the bulkheads connect the vertical sidewall to a manway located at the hub of the second circular plate, form the initial internal floating roof.

6. A gasketed container is attached to the deck of the IFR between the bulkheads, the container has an opening at the bottom through the deck, and a pressure valve at also attached to the deck between the bulkheads, and has a pipe that communicates with the space below the plate and the above the plate, similar to the gasketed port/sleeve, forming the finished structure of the internal floating roof.

7. The internal floating roof is then hoisted into the shell cylinder, and is attached to the deck support legs, leaving a space below.

8. One or more manways and ports are cut into the shell, to access the cavity formed by the IFR mounted within the shell cylinder.

9. An anti-rotation device, such as a pipe or ladder or modified cylinder, to prevent the IFR from rotating while in operation inside the tank, is inserted into the gasketed port/sleeve, and is welded to the floor of the tank.

10. The remaining shell panels are installed until the desired height is obtained.

11. A fix roof is then attached to the top of the shell. The roof can be conical, but also requires a second gasketed port/sleeve to receive and secure the top portion of the anti-rotation device.

12. Additional sealed ports and vents are added to comply with API 650 standards for emission safe tanks.

13. To prevent the IFR from rising too far and making contact with the roof, optional cables or a top shelf can be deployed across the top portion of the highest shell stack adjacent the roof 14. In most instances, the inside of the first stack requires prepping and coating with a protective coating common in the industry.

15. One important optional feature is an inlet loading port having a diffuser attached at the inside end of the pipe. When liquids are loaded, they are frequently loaded at a very high rate since the loading employees are often paid based on speed/volume, but this can cause problems. One problems is that liquids at high force can leak through the IFR seal and flood the deck pan of the IFR, defeating the purpose of the IFR. Another problem is that poorly loaded liquids can cause suspended components in the liquids to settle out or separate. This is a hazard. Accordingly, a diffuser such as a pipe having radiator holes or a pipe fitting that causes the liquid to spray during loading will be the liquid subcomponents mixed and suspended.

EXAMPLES

Example 1

A full contact internal floating roof for a transfer tank has a rigid horizontal circular deck; a rigid vertical sidewall attached around the circumferential periphery of the circular deck, the sidewall extending perpendicularly from the circular deck; a rigid circular manway hub attached to a center region of the circular deck, the rigid circular manway hub having a removable cover; a plurality of bulkhead spoke members mounted on the deck and extending vertically in the same direction perpendicularly as the sidewall, the bulkhead spoke members extending horizontally and connecting the manway hub to the vertical sidewall at regular intervals; at least one mechanical wiper disposed on the outer surface of the vertical sidewall for providing an operational seal with an inner shell wall of a transfer tank; a pressure vent mounted on the deck, the pressure vent comprising a sleeve that extends through the deck, and a gasketed pipe disposed within the sleeve, a bleeder valve caps the pipe; a rigid gasketed sleeve mounted on the deck, the gasketed sleeve extends through the deck providing a sealed aperture through the deck; an anti-rotation device extending vertically from a floor of the transfer tank through the gasketed sleeve of the circular deck and continuing vertically through a roof of the transfer tank, the anti-rotation device configured to have a cross-sectional shape operatively matching a cross-sectional shape of the gasketed sleeve, wherein the circular deck is prevented from rotating about a vertical axis.

Example 2

A full contact internal floating roof for a transfer tank has a rigid horizontal circular deck; a rigid vertical sidewall attached around the circumferential periphery of the circular deck, the sidewall extending perpendicularly from the circular deck; a rigid circular manway hub attached to a center region of the circular deck, the rigid circular manway hub having a removable cover; a plurality of bulkhead spoke members mounted on the deck and extending vertically in the same direction perpendicularly as the sidewall, the bulkhead spoke members extending horizontally and connecting the manway hub to the vertical sidewall at regular intervals; at least one mechanical wiper disposed on the outer surface of the vertical sidewall for providing an operational seal with an inner shell wall of a transfer tank; a pressure vent mounted on the deck, the pressure vent comprising a sleeve that extends through the deck, and a gasketed pipe disposed within the sleeve, a bleeder valve caps the pipe; a rigid gasketed sleeve mounted on the deck, the gasketed sleeve extends through the deck providing a sealed aperture through the deck; an anti-rotation device extending vertically from a floor of the transfer tank through the gasketed sleeve of the circular deck and continuing vertically through a roof of the transfer tank, the anti-rotation device configured to have a cross-sectional shape operatively matching a cross-sectional shape of the gasketed sleeve, wherein the circular deck is prevented from rotating about a vertical axis; and wherein the IFR deck comprises a removable deck leg, the deck leg removably connecting the internal floating roof to the tank to prevent movement of the internal floating roof during transportation of the tank.

Example 3

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof , the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0.

Example 4

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof, the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions are 32 feet in height and 15.5 feet in diameter.

Example 5

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof , the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0, wherein the circular deck is 20 feet in diameter.

Example 6

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof, the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0, and wherien the IFR has a rigid vertical sidewall 12 to 30 inches in height above the IFR deck.

Example 7

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof , the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0, and wherein the IFR has a rigid vertical sidewall 12 to 30 inches in height above the IFR deck, and wherein the IFR has two mechanical wipers disposed on an outer surface of the vertical sidewall.

Example 8

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof , the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0, and wherein the IFR has a rigid vertical sidewall 12 to 30 inches in height above the IFR deck, and wherein the IFR has one or two mechanical wipers disposed on an outer surface of the vertical sidewall, and wherein the anti-rotation device is configured to have a rectangular cross-sectional shape, e.g. to accommodate a vertical ladder support assembly as part of the anti-rotation device where the ladder that travels through a gasketed port/sleeve in the deck of the IFR.

Example 9

A liquid transfer tank has a shell wall and a full-contact floating roof having an anti-rotation device and having transportation deck legs, the IFR designed to move vertically within the tank, float upon the surface of product stored in the tank, the tank having: a cone-shaped roof , the cone-shaped roof having a roof manway, the roof manway having the anti-rotation device disposed there through; a cylindrical shell wall connecting the cone-shaped roof to a tank bottom panel, the shell wall having a circular first manway disposed therethough, and having a rectilinear second manway disposed therethrough, wherein the tank ranges in storage capacity from 750 to 5000 barrels, and wherein the tank dimensions have a height to diameter ratio ranging from 1.5 to 3.0, and wherein the IFR has a rigid vertical sidewall 12 to 30 inches in height above the IFR deck, and wherein the IFR has one or two mechanical wipers disposed on an outer surface of the vertical sidewall, and wherein the anti-rotation device is configured to have either a cylindrical cross-sectional shape e.g. cylinder having a ladder steps on or within the cylinder, or an irregular curvilinear cross-sectional shape, e.g. where the ladder has one larger diameter vertical cylinder attached by rungs to a smaller diameter vertical cylinder, or an irregular rectilinear cross-sectional shape shape, e.g. an L-shaped ladder, or other ladder or support shape that functions with the IFR to travel vertically and provides the anti-rotation purpose of the ARD device where the support that travels through a gasketed port/sleeve in the deck of the IFR from the bottom to the roof of the tank.

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A liquid transfer tank, comprising:

an internal floating roof disposed within a cylindrical shell wall, the internal floating roof comprising a horizontal circular deck, a vertical sidewall attached around a circumferential periphery of the rigid horizontal circular deck, and extending perpendicularly from the horizontal circular deck, the vertical sidewall in operative contact with an inner surface of the cylindrical shell wall;

the cylindrical shell wall having a bottom floor plate attached to a lower portion of the cylindrical shell wall, and a cone-shaped fixed roof attached to an upper portion of the cylindrical shell wall, wherein the cylindrical shell wall comprises welded steel panels, wherein the cylindrical shell wall is single walled or double walled, and wherein the cylindrical shell wall has an internal lining on an inner surface of the cylindrical shell wall, wherein the liquid transfer tank has a height governor attached to the inner surface of the upper interior portion of the cylindrical shell wall adjacent the fixed roof to prevent the internal floating roof from rising too far and making contact with the fixed roof, wherein the height governor comprises one or more cables or shelf units, a first manway mounted on a lower portion of the cylindrical shell wall providing access to a lower interior space within the cylindrical shell wall, a roof port/sleeve extending from an upper interior space within the cylindrical shell wall through the fixed roof, a second manway mounted to a center region of the horizontal circular deck of the internal floating roof, the second manway having a removable cover;

a plurality of bulkhead spoke members mounted on the horizontal circular deck and extending vertically in the same direction perpendicularly as the vertical sidewall, the bulkhead spoke members extending horizontally and disposed between the second manway and the vertical sidewall at regular intervals;

at least one mechanical wiper disposed on the outer surface of the vertical sidewall providing an operational seal with the inner surface of the shell wall;

a pressure vent mounted on the circular deck of the internal floating roof, the pressure vent comprising a sleeve that extends through the horizontal circular deck connecting the upper interior space with the lower interior space, and a gasketed pipe disposed within the sleeve, a bleeder valve caps the gasketed pipe;

a second gasketed sleeve that extends through the horizontal circular deck connecting the upper interior space with the lower interior space;

a ladder extends vertically from the bottom floor plate through the second gasketed sleeve of the horizontal circular deck and continuing vertically through the roof port/sleeve of the fixed roof, the ladder configured to prevent the horizontal circular deck from rotating about a vertical axis; and an inlet pipe mounted on the lower portion of the cylindrical shell wall and configured to load liquid into the lower interior space, wherein the inlet pipe is fitted with a diffuser element that causes liquid to spray during loading, a serial connection port mounted in the lower portion of the cylindrical shell wall to connect multiple adjacent tanks, and comprising a hatbox vent explosion proof vent in the fixed roof and a plurality of downward facing side wall vents mounted on the upper portion of the cylindrical shell wall to allow the internal floating roof to move up and down without creating a vacuum and to allow vapor to discharge freely, and a square access door mounted in the lower portion of the cylindrical shell wall; and, comprising a removable deck leg, the deck leg removably connecting the internal floating roof to the bottom floor plate.

2. The liquid transfer tank of claim 1, wherein the circular deck is from 10 to 20 feet in diameter.

3. The liquid transfer tank of claim 1, wherein the rigid vertical sidewall is from 6 to 36 inches in height above the IFR deck.

4. The liquid transfer tank of claim 1, wherein the bulkhead spoke members are 4 to 9 feet in length from an outer surface of the manway hub to the vertical sidewall.

5. The liquid transfer tank of claim 1, wherein the at least one mechanical wiper comprises two mechanical wipers, wherein a first of the two mechanical wipers disposed on an upper portion of the outer surface of the vertical sidewall, said upper portion distal from the IFR deck, and a second of the two mechanical wipers disposed on a lower portion of the outer surface of the vertical sidewall, said lower portion proximal to the IFR deck.

6. The liquid transfer tank of claim 1, wherein the at least one mechanical wiper comprises two mechanical wipers, wherein both of the two mechanical wipers are disposed on an upper portion of the outer surface of the vertical sidewall, said upper portion distal from the IFR deck.

7. The liquid transfer tank of claim 1, wherein the at least one mechanical wiper comprises two mechanical wipers, wherein both of the two mechanical wipers are disposed on a lower portion of the outer surface of the vertical sidewall, said lower portion proximal to the IFR deck.

8. The liquid transfer tank of claim 1, wherein the tank ranges in storage capacity from 750 to 5000 barrels.

9. The liquid transfer tank of claim 1, wherein the tank dimensions have a height to diameter ratio ranging from 1.5 to 3.0.

10. The liquid transfer tank of claim 1, wherein the liquid transfer tank is a removable storage tank, configured for addition to a tank storage yard and for removal and re-allocation to a new location using a moving truck and crane.

11. A method of providing a movable liquid transfer tank, comprising:

providing the liquid transfer tank of claim 1;

re-locating the liquid transfer tank with an expandable tank cluster within a storage tank yard, wherein relocating is selected from adding the liquid transfer tank using a moving truck and crane to the expandable tank cluster within the storage tank yard, and removing the liquid transfer tank using a moving truck and crane from the expandable tank cluster within the storage tank yard.

12. A system for re-allocating modular storage tanks, comprising:

An array of a plurality of the liquid transfer tank of claim 1 within a tank storage yard, wherein each of the plurality of liquid transfer tanks is a removable storage tank, configured for addition to a tank storage yard and for removal and re-allocation to a new location using a moving truck and crane.

* * * * *